US008985746B2

(12) United States Patent
Kubota

(10) Patent No.: US 8,985,746 B2
(45) Date of Patent: Mar. 24, 2015

(54) LIQUID JET HEAD, LIQUID JET APPARATUS, AND METHOD OF MANUFACTURING LIQUID JET HEAD

(71) Applicant: SII Printek Inc., Chiba (JP)

(72) Inventor: Yuzuru Kubota, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 14/061,987

(22) Filed: Oct. 24, 2013

(65) Prior Publication Data

US 2014/0118440 A1 May 1, 2014

(30) Foreign Application Priority Data

Oct. 29, 2012 (JP) ..... 2012-238336

(51) Int. Cl.

*B41J 2/045* (2006.01)
*B41J 2/14* (2006.01)
*B41J 2/16* (2006.01)

(52) U.S. Cl.

CPC ..... *B41J 2/14209* (2013.01); *B41J 2/1609* (2013.01); *B41J 2/1623* (2013.01); *B41J 2/1631* (2013.01); *B41J 2/1632* (2013.01); *B41J 2/1642* (2013.01); *B41J 2202/12* (2013.01)

USPC ..... 347/68

(58) Field of Classification Search

CPC ..... B41J 2/14233; B41J 2002/14459; B41J 2/1607; B41J 2/04581; B41J 2/14201

USPC ..... 347/20, 40, 54, 56, 68, 70–72, 86, 347/25.35, 890.1

See application file for complete search history.

(56) References Cited

U.S. PATENT DOCUMENTS

| | | | | |
|---|---|---|---|---|
| 7,018,023 | B2 * | 3/2006 | Shimada | 347/71 |
| 7,645,030 | B2 * | 1/2010 | Koseki | 347/69 |
| 8,152,283 | B2 * | 4/2012 | Owaki | 347/71 |

FOREIGN PATENT DOCUMENTS

| | | |
|---|---|---|
| JP | 2007190982 | 8/2007 |
| JP | 2009532237 | 9/2009 |
| JP | 2011104791 | 6/2011 |
| WO | 2008139949 | 11/2008 |

OTHER PUBLICATIONS

IPO Search Report mailed Apr. 28, 2014 issued in Appln. No. GB1319063.2.

* cited by examiner

*Primary Examiner* — An Do
(74) *Attorney, Agent, or Firm* — Adams & Wilks

(57) ABSTRACT

A liquid jet head has an actuator substrate, a cover plate and a nozzle plate. The actuator substrate includes a groove array formed by alternately arraying an ejection groove and a dummy groove, and a common chamber communicating with one end of the ejection groove but not communicating with the dummy groove. The cover plate is provided on a top surface of the actuator substrate so as to cover the groove array, and includes one chamber communicating with the common chamber and another chamber communicating with another end of the ejection groove. The nozzle plate is provided on a bottom surface of the actuator substrate so as to cover the groove array, and includes a nozzle communicating with the ejection groove.

21 Claims, 13 Drawing Sheets

Prior art

LIQUID JET HEAD, LIQUID JET APPARATUS, AND METHOD OF MANUFACTURING LIQUID JET HEAD

BACKGROUND

1. Technical Field

The present invention relates to a liquid jet head for ejecting and recording droplets on a recording medium, a liquid jet apparatus, and a method of manufacturing the liquid jet head.

2. Related Art

In recent years, there has been utilized an ink jet type liquid jet head for ejecting droplets, such as ink, on a recording paper or the like and recording characters or graphics, or an ink jet type liquid jet head for ejecting a liquid material on a surface of an element substrate and forming a functional thin film. In this system, ink or a liquid material (hereinafter, referred to as "liquid") is guided to a channel from a liquid tank via a supply tube, a pressure is applied to the liquid filling the channel, and the liquid is ejected from a nozzle communicated with the channel. When the liquid is ejected, the liquid jet head or the recording medium is moved and characters or graphics are recorded, or a functional thin film having a predetermined configuration is formed.

FIG. 20 is a schematic partial cross-sectional view (FIG. 3 in JP 2009-532237 W) of an ink jet head 100 which is a liquid jet head of this type. The ink jet head 100 has a laminate structure including a nozzle plate 124, a cover member 126, a piezoelectric member 128, and a base material 136. A pair of nozzles 130 is formed on the nozzle plate 124, which is an uppermost layer. A straightedge-shaped opening 129 corresponding to each of the nozzles 130 is formed at the cover member 126, which is a layer under the nozzle plate 124. The pair of piezoelectric members 128 formed by two trapezoidal walls and a frame member 138 which is on the outside thereof are provided between the cover member 126 and the base material 136. A manifold 132 for introducing liquid and a manifold 134 for discharging the liquid are formed at the base material 136. The plurality of piezoelectric members 128 as trapezoidal walls is arrayed separately in a direction vertical to the paper surface, and a channel is formed between the two piezoelectric members 128 arrayed in the direction vertical to the paper surface. Accordingly, the ink jet head 100 is provided with a plurality of paired two channels formed in parallel in the direction vertical to the paper surface.

FIG. 21 is a perspective view of the ink jet head 100, from which the above-described nozzle plate 124 and cover member 126 have been removed (FIG. 4 in JP 2009-532237 W). The manifold 132 for introducing the liquid and the manifold 134 for discharging the liquid are formed at the base material 136, which is a lower layer. The piezoelectric members 128, which are trapezoidal walls, are provided between the manifolds 132, 134 in parallel in two rows and a periphery thereof is surrounded by the frame member 138. Accordingly, the ink jet head 100 has a structure in which the liquid introduced through the manifold 132 flows in the channel between the trapezoidal walls formed by the piezoelectric members 128, is discharged through the manifolds 134 on both sides, and does not flow to the outside of the frame member 138. A drive electrode (not illustrated) is formed on each side surface of the trapezoidal piezoelectric member 128. When a voltage is applied to the drive electrodes on these side surfaces, the piezoelectric member 128 is deformed in a shear mode, generating a pressure wave in the liquid in the channel. Droplets are ejected from the nozzle 130 by this pressure wave.

Here, a plurality of wiring electrodes is formed on a surface of the base material 136 on the channel side. One end of the wiring electrode is connected to the drive electrode on the side surface of the piezoelectric member 128 and another end thereof is connected to an electrode terminal or a driver IC, which is provided outside an outer periphery of the frame member 138. Consequently, a drive signal for driving the piezoelectric member 128 is supplied from the nozzle plate 124 side of the base material 136. It should be noted that JP 2009-532237 W describes an example in which the cover member 126 illustrated in FIG. 20 can be removed and the nozzle plate 124 is directly provided on a top surface of the piezoelectric member 128, which is a movable wall.

FIG. 22 is a schematic cross-sectional view of another liquid jet head 101 (FIG. 4 in JP 2011-104791 A). The liquid jet head 101 has a laminate structure including a nozzle plate 102, a piezoelectric plate 104, a cover plate 108, and a flow path member 111. Liquid is ejected from a pair of nozzles 103*a*, 103*b*. A deep groove 105*a* and a shallow groove 105*b* are alternately formed at the piezoelectric plate 104 in a direction vertical to the paper surface. The deep groove 105*a* has a depth reaching the nozzle plate 102 and communicates with the pair of nozzles 103*a*, 103*b*. The shallow groove 105*b* has a depth not reaching the nozzle plate 102. The deep groove 105*a* and the shallow groove 105*b* of the piezoelectric plate 104 are partitioned by a wall formed by the piezoelectric plate 104, and a drive electrode (not illustrated) is formed on each side surface of the wall. Liquid supplied from a supply joint 114 flows into the deep groove 105*a* via a liquid supply chamber 112 and a liquid supply port 109, flows out to a pair of liquid discharge ports 110*a*, 110*b*, and is discharged from a pair of liquid discharge chambers 113*a*, 113*b* and discharge joints 115*a*, 115*b*. Meanwhile, since an upper opening of the shallow groove 105*b* is blocked by the cover plate 108, the liquid does not flow therein.

By applying a drive signal to the drive electrodes on the wall partitioning the deep groove 105*a* and the shallow groove 105*b*, the wall is deformed in a thickness-shear mode, generating a pressure wave in the liquid filling the deep groove 105*a*. As a result, droplets are ejected from the nozzles 103*a*, 103*b*. Wiring electrodes (not illustrated) are formed on a surface of the piezoelectric plate 104 on the cover plate 108 side. One end of the wiring electrode is connected to the drive electrode formed on the wall and another end thereof is connected to an electrode terminal formed on a surface of the cover plate 108 side. The electrode terminal is connected to a drive circuit via a flexible substrate or the like.

SUMMARY

In the ink jet head 100 described in JP 2009-532237 W, the electrode terminal is formed on the surface of the base material 136 on the nozzle plate 124 side, and it is necessary to connect the driver IC, which supplies the drive signal, or a flexible substrate to this electrode terminal. In the ink jet head 100 of this type, a gap between the nozzle plate 124 and a recording medium is extremely narrow. As a result, the driver IC or the flexible substrate provided on the surface of the base material 136 on the nozzle plate 124 side needs to be formed thin. Further, it is necessary to electrically separate the drive electrodes formed on the both side surfaces of the trapezoidal wall formed by the piezoelectric member 128. However, since there is a large difference in height between a top surface and a tilted surface of the trapezoidal wall, it is difficult to carry out electrode patterning by a photolithography or an etching method. As a result, it is necessary to irradiate the top surface and the tilted surface of the individual wall with a laser light and carry out patterning of the electrodes on the both side surfaces. Since production is difficult and manufacturing process steps take a long time, mass productivity is low.

Moreover, in the liquid jet head 101 described in JP 2011-104791 A, the shallow groove 105*b* leaves a piezoelectric plate at a groove bottom. Each groove is formed using a dicing blade (also referred to as "diamond blade") in which abrasive grains of, for example, diamond, are embedded in an outer peripheral portion of a metal disk. As a result, an outer configuration of this dicing blade is left at both end portions of the shallow groove 105*b* where the groove bottom is not penetrated. For example, when the dicing blade having a diameter of 2 to 4 inches is used, a total width of a circular configuration of the both end portions of the shallow groove 105*b* in the groove direction reaches 8 mm to 12 mm. As a result, the liquid jet head 101 becomes wider in the groove direction and the liquid jet head 101 becomes heavier.

Further, in the liquid jet head 101, the liquid is supplied from the liquid supply port 109 formed at the cover plate 108 to the plurality of deep grooves 105*a*. In other words, the liquid is supplied to each of the deep grooves 105*a* from the cover plate 108 side. It is desirable that the liquid be supplied uniformly to each of the deep grooves 105*a*. To this end, it is preferable that an inner volume of the liquid supply port 109 or the liquid supply chamber 112 be large. Meanwhile, the small and light liquid jet head 101 is required.

The present invention has been made in consideration of the above-described problems, and an object thereof is to provide a liquid jet head, a liquid jet apparatus, and a method of manufacturing the liquid jet head, which can uniformly supply liquid to individual channels without increasing a thickness of the liquid jet head and can be manufactured easily.

A liquid jet head of the present invention includes: an actuator substrate including a groove array formed by alternately arraying an ejection groove and a dummy groove, and a common chamber communicating with one end of the ejection groove; a cover plate including one chamber communicating with the common chamber and another chamber communicating with another end of the ejection groove, and provided on a top surface of the actuator substrate so as to cover the groove array; and a nozzle plate including a nozzle communicating with the ejection groove, and provided on a bottom surface of the actuator substrate so as to cover the groove array.

Further, the ejection groove includes a first ejection groove and a second ejection groove and the dummy groove includes a first dummy groove and a second dummy groove, the groove array includes a first groove array and a second groove array with the common chamber therebetween, the first ejection groove and the first dummy groove are alternately arrayed in the first groove array, and the second ejection groove and the second dummy groove are alternately arrayed in the second groove array, the other chamber includes a first chamber and a second chamber with the one chamber therebetween, the first chamber communicates with another end of the first ejection groove, and the second chamber communicates with another end of the second ejection groove, and the nozzle includes a first nozzle and a second nozzle, the first nozzle communicates with the first ejection groove, and the second nozzle communicates with the second ejection groove.

Further, the ejection groove is formed from the common chamber to the vicinity of an outer peripheral end of the actuator substrate in a direction intersecting an array direction of the groove array.

Further, the dummy groove is formed from the outer peripheral end of the actuator substrate to the vicinity of the common chamber.

Further, the first ejection groove and the second ejection groove are formed straight in a groove direction.

Further, in an array direction of the first or second groove array, a plurality of the first ejection grooves and a plurality of the second ejection grooves have the same pitch, and the first ejection grooves are deviated from the second ejection grooves by a ½ pitch.

Further, in the array direction of the first or second groove array, the first nozzle forms a first nozzle array and the second nozzle forms a second nozzle array, a plurality of the first nozzles and a plurality of the second nozzles have the same pitch, and the first nozzles are deviated from the second nozzles by a ½ pitch.

Further, the groove direction of the first or second ejection groove is inclined relative to the array direction of the first or second groove array.

Further, common electrodes electrically connected to each other are formed on both side surfaces of the ejection groove, active electrodes electrically separated from each other are formed on both side surfaces of the dummy groove, an active terminal is electrically connected to the two active electrodes formed on the side surfaces of the adjacent dummy grooves on adjacent sides, the active terminal being provided between the adjacent dummy grooves with the ejection groove therebetween and on a top surface of the actuator substrate in the vicinity of the outer peripheral end thereof, and a common terminal is electrically connected to the common electrodes and electrically separated from the active terminal, the common terminal being provided on the top surface of the actuator substrate in the vicinity of the other end of the ejection groove.

Further, the common electrodes are formed on substantially the upper half of the side surfaces of the ejection groove, and the active electrodes are formed on substantially the upper half of the side surfaces of the dummy groove.

Further, the cover plate covers the groove array, exposes the active terminal and the common terminal, and is adhered to the top surface of the actuator substrate.

Further, the liquid jet head further includes a flexible substrate including a common wiring and a plurality of active wirings and bonded to the top surface of the actuator substrate, wherein the common wiring is electrically connected to a plurality of the common terminals, and the plurality of active wirings is electrically connected to the plurality of active terminals, respectively.

Further, the liquid jet head further includes a reinforcing plate provided between the bottom surface of the actuator substrate and the nozzle plate and provided with through holes penetrating at positions corresponding to the first and second nozzles in a plate thickness direction.

Further, liquid is supplied from outside to the common chamber and is discharged from the other chamber to the outside.

Further, a reinforcing bridge is provided at the one chamber.

A liquid jet apparatus of the present invention includes: the liquid jet head according to any one of the aspects described above; a moving mechanism configured to relatively move the liquid jet head and a recording medium; a liquid supply tube configured to supply liquid to the liquid jet head; and a liquid tank configured to supply the liquid to the liquid supply tube.

A method of manufacturing a liquid jet head of the present invention includes: a groove formation step of forming a first groove array in which first ejection grooves are arrayed and a second groove array in which second ejection grooves are arrayed, the first and second groove arrays being formed in parallel on an actuator substrate including a piezoelectric material; a common chamber formation step of forming, on the actuator substrate between the first groove array and the second groove array, a common chamber communicating with each one end of the first and second ejection grooves; a cover plate formation step of forming, on a cover plate, one chamber, and a first chamber and a second chamber with the one chamber therebetween; a first adhesion step of adhering the cover plate to a top surface of the actuator substrate by communicating the one chamber with the common chamber, by communicating the first chamber with another end of the first ejection groove, and by communicating the second chamber with another end of the second ejection groove; and a second adhesion step of adhering a nozzle plate including a first nozzle and a second nozzle to a bottom surface of the actuator substrate by communicating the first nozzle with the first ejection groove and communicating the second nozzle with the second ejection groove.

Further, the groove formation step is a step of alternately forming the first ejection groove and a first dummy groove in the first groove array and alternately forming the second ejection groove and a second dummy groove in the second groove array.

Further, the groove formation step is a step of forming the groove at a depth which does not reach the bottom surface of the actuator substrate opposite to the top surface thereof, and the method further includes a grinding step of grinding the bottom surface after the first adhesion step so as to cause the first and second ejection grooves and the common chamber to penetrate.

Further, the second adhesion step includes a step of adhering a reinforcing plate to the bottom surface of the actuator substrate and then adhering the nozzle plate to the reinforcing plate, the reinforcing plate having through holes penetrating at positions corresponding to the first and second nozzles in a plate chicness direction.

Further, the method of manufacturing a liquid jet head further includes, after the groove formation step, a conductive film formation step of forming a conductive film on the top surface of the actuator substrate according to oblique deposition.

Further, in the conductive film formation step, a mask for covering an area where the common chamber is formed, end portions of the first and second dummy grooves on the common chamber side, and end portions of the first and second ejection grooves on the common chamber side is provided on the top surface of the actuator substrate, and thereafter, the conductive film is formed.

The liquid jet head of the present invention includes: the actuator substrate including the groove array formed by alternately arraying the ejection groove and the dummy groove, and the common chamber communicating with the one end of the ejection groove; the cover plate including the one chamber communicating with the common chamber and the other chamber communicating with the other end of the ejection groove, and provided on the top surface of the actuator substrate so as to cover the groove array; and the nozzle plate including the nozzle communicating with the ejection groove, and provided on the bottom surface of the actuator substrate so as to cover the groove array. With this configuration, the liquid jet head can be miniaturized, the liquid can be uniformly supplied to each ejection groove, and an ejection condition of droplets ejected from each nozzle is equalized.

DETAILED DESCRIPTION

<Liquid Jet Head>

Figure 1:
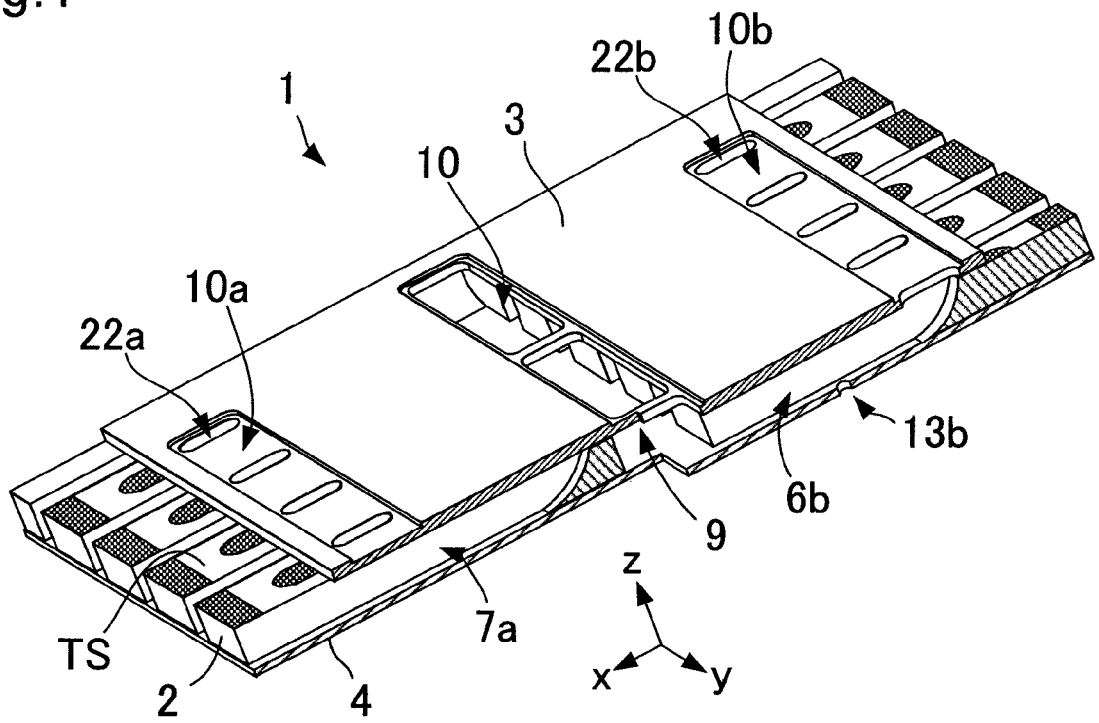
FIG. 1 is a schematic partial perspective view of a liquid jet head according to a first embodiment of the present invention.

A liquid jet head according to an embodiment of the present invention has a laminate structure including a nozzle plate, an actuator substrate, and a cover plate. The actuator substrate includes a groove array formed by alternately arraying an ejection groove and a dummy groove, and a common chamber communicating with one end of the ejection groove. The cover plate includes one chamber communicating with the common chamber of the actuator substrate and another chamber communicating with the ejection grooves. The cover plate is provided on a top surface of the actuator substrate so as to cover the groove arrays. The nozzle plate includes nozzles, which communicate with the ejection grooves, and is provided on a bottom surface of the actuator substrate so as to cover the groove arrays.

Here, the ejection groove penetrates from the top surface of the actuator substrate to the bottom surface thereof in a plate thickness direction. Therefore, to form the ejection groove, a dicing blade can grind the ejection groove deeper than a final depth thereof and a width of a circular configuration at another end of the ejection groove can be formed remarkably smaller. Further, since it is not necessary to form an area for storing liquid, such as a common chamber, at the actuator substrate on the other end side of the ejection groove, drive electrodes or the like can be formed intensively at the actuator substrate on the other end side of the ejection groove. Moreover, the common chamber of the actuator substrate and the one chamber of the cover plate constitute a liquid supply chamber or a liquid combining chamber. As a result, the liquid jet head can be miniaturized, an inner volume of the liquid supply chamber or the liquid combining chamber increases and the liquid can be uniformly supplied to each ejection groove, and an ejection condition of droplets ejected from each nozzle is equalized.

Further, another liquid jet head of the present invention has a laminate structure including a nozzle plate, an actuator substrate, and a cover plate. A part or a whole of the actuator substrate is formed of a piezoelectric body. The actuator substrate includes a first groove array formed by alternately arraying a first ejection groove and a first dummy groove, a second groove array which is formed by alternately arraying a second ejection groove and a second dummy groove and is parallel to the first groove array, and a common chamber provided between the first groove array and the second groove array and communicating with respective one ends of the first and second ejection grooves. In other words, the ejection groove includes the first ejection groove and the second ejection groove, the dummy groove includes the first dummy groove and the second dummy groove, the groove array includes the first groove array and the second groove array, and the common chamber is provided between the first groove array and the second groove array. Moreover, at least the first and second ejection grooves penetrate from a top surface of the actuator substrate to a bottom surface thereof. Furthermore, a groove direction of the first and second ejection grooves and an array direction of the first and second groove arrays intersect. The intersection is not limited to an intersection at a right angle and may be an intersection at a tilted angle. Additionally, the groove direction of the first ejection groove and the groove direction of the second ejection groove are parallel to each other. However, the directions are not necessarily straight and may be staggered alternately.

The cover plate is provided on the top surface of the actuator substrate and includes one chamber communicating with the common chamber of the actuator substrate, a first chamber communicating with another ends of the first ejection grooves, and a second chamber communicating with another ends of the second ejection grooves. In other words, another chamber includes the first chamber and the second chamber, and the one chamber is sandwiched between the first chamber and the second chamber. The nozzle plate covers the first and second groove arrays of the actuator substrate and is provided on the bottom surface of the actuator substrate so as to block the common chamber. The nozzle plate includes a first nozzle communicating with the first ejection groove and a second nozzle communicating with the second ejection groove. In other words, the nozzle includes the first nozzle and the second nozzle.

Liquid flows from the one chamber of the cover plate into the common chamber of the actuator substrate, flows from one end of the first ejection groove to the other end thereof, and flows out to the first chamber of the cover plate. Further, the liquid flows from one end of the second ejection groove to the other end thereof and flows out to the second chamber of the cover plate. Moreover, the liquid may flow in the opposite direction. In other words, it is possible that the liquid flows into the first chamber and the second chamber, flows from the other end of the first ejection groove to the one end thereof and from the other end of the second ejection groove to the one end thereof and is combined in the common chamber, and flows out to the one chamber. The common chamber of the actuator substrate supplies the liquid to the individual ejection grooves or combines the liquid. The common chamber and the one chamber provided on the cover plate form a liquid supply chamber or a liquid combining chamber.

In this way, since the first and second ejection grooves penetrate from the top surface to the bottom surface, when the first and second ejection grooves are formed, the dicing blade can grind the ejection grooves deeper than final depths thereof. As a result, widths of circular configurations at the other ends of the ejection grooves can be formed remarkably smaller than a case of JP 2009-532237 W, and the liquid jet head can be miniaturized. Further, since it is not necessary to form an area for storing liquid, such as a common chamber, at the actuator substrate on the other end sides of the first and second ejection grooves, drive electrodes or the like can be formed intensively at the actuator substrate on the other end sides of the first and second ejection grooves, i.e., outer peripheral areas of the actuator substrate. Moreover, since the common chamber of the actuator substrate in addition to the one chamber of the cover plate can be the liquid supply chamber or the liquid combining chamber, an inner volume of the liquid supply chamber or the liquid combining chamber can be increased without increasing a total thickness of the liquid jet head. This reduces a difference in flow path resistance between the first or second ejection groove disposed at an end portion of the first groove array or the second groove array and the first or second ejection groove disposed at a central portion thereof. As a result, a flow velocity of the liquid at each ejection groove is uniform and an ejection condition of droplets ejected from each nozzle is equalized. Further, drive electrode terminals can be provided on the top surface of the actuator substrate, and it is not necessary to form electrode terminals on the nozzle plate side. Thus, it is easier to connect an electrode at the actuator substrate and an electrode at a drive circuit.

It should be noted that the actuator substrate uses an electrostrictive effect of the piezoelectric body and that the entire actuator substrate may be the piezoelectric body or only a wall between the adjacent ejection grooves may be the piezoelectric body and the other part may be an insulating body. PZT (piezoelectric zirconate titanate) or $BaTiO_3$ (barium titanate) subjected to a polarization treatment in a direction perpendicular to a plate surface can be used as the piezoelectric body. Further, two laminated piezoelectric substrates subjected to the polarization treatment in the direction perpendicular to the plate surface and in directions opposite to each other can be used as the actuator substrate. A material having a coefficient of thermal expansion closer to that of the actuator substrate, e.g., PZT ceramics, machinable ceramics, or a synthetic resin can be used for the cover plate. A polyimide film can be used for the nozzle plate. As described in JP 2009-532237 W, even if a thin polyimide film is directly adhered onto the top surface of the piezoelectric member, the pressure wave which is sufficient to eject droplets from the nozzle can be generated at the liquid in the channel. The present invention will be described below in detail using the drawings.

First Embodiment

Figure 2:
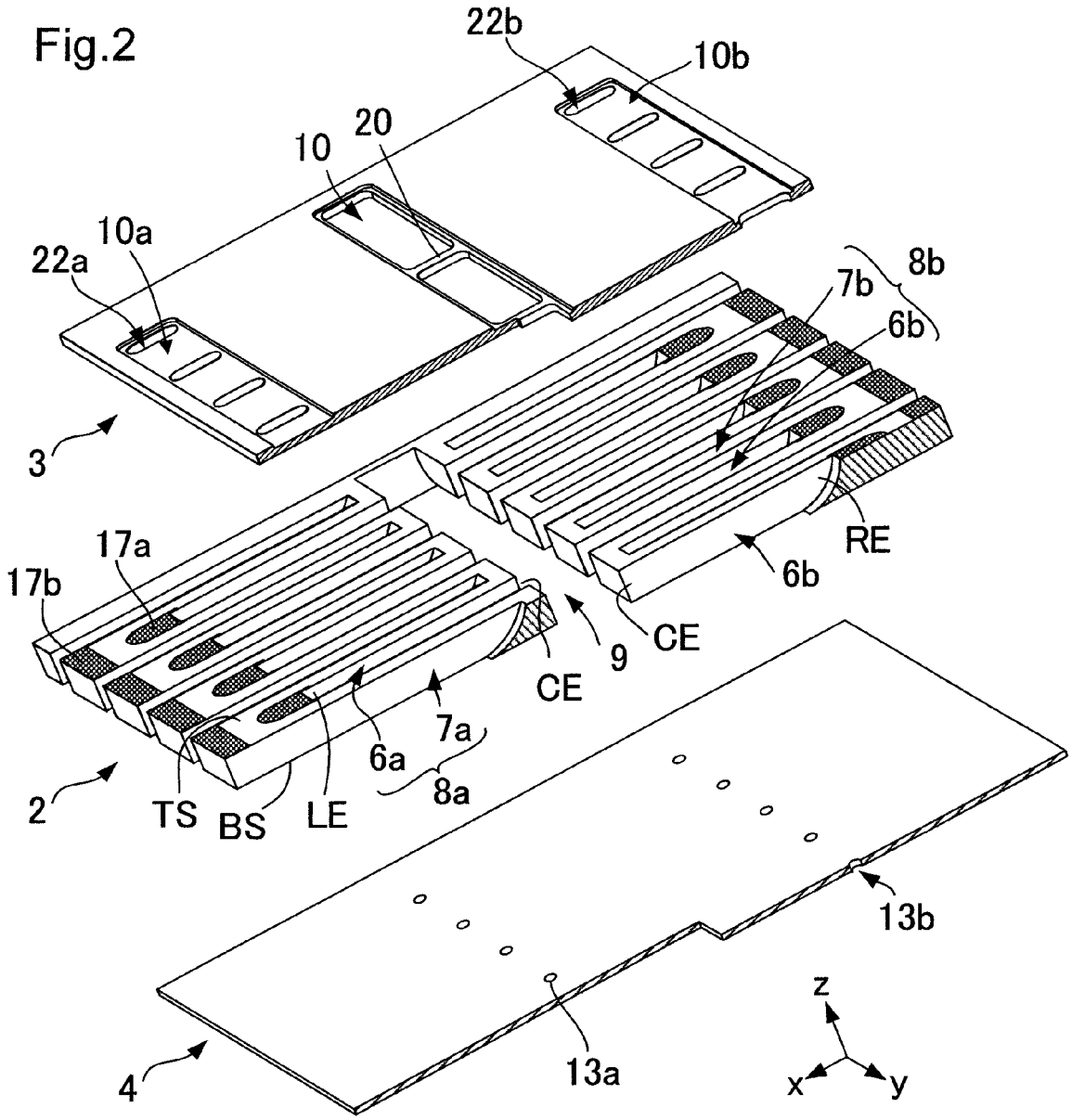
FIG. 2 is a schematic exploded perspective view of the liquid jet head according to the first embodiment of the present invention.
Figure 3A:
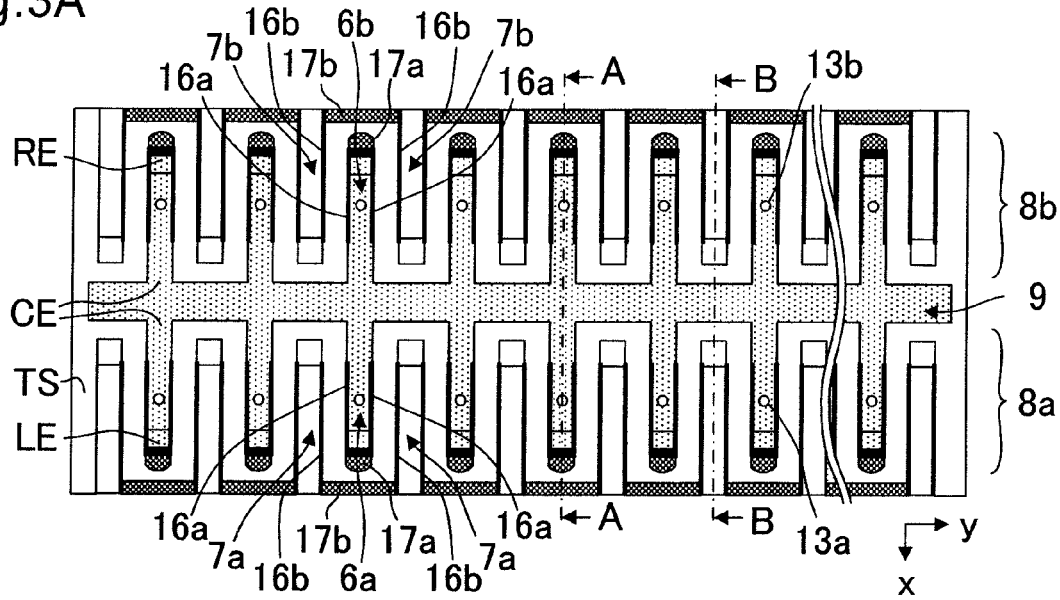
FIGS. 3A to 3C are diagrams for explaining the liquid jet head according to the first embodiment of the present invention.
Figure 3B:
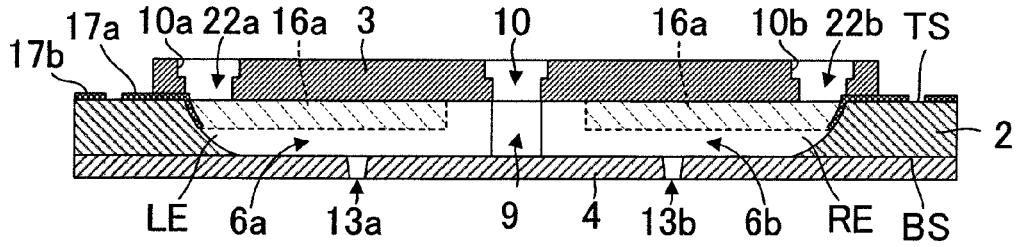
Figure 3C:
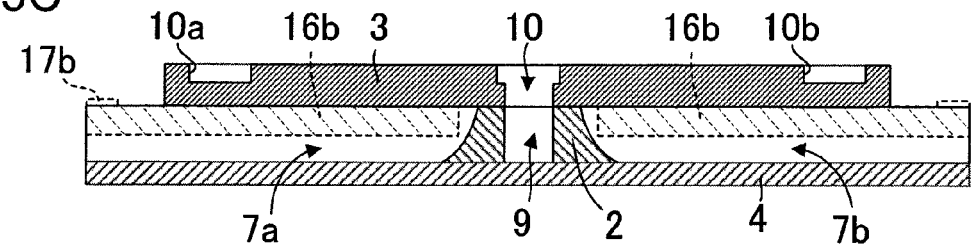

FIGS. 1 to 3C are diagrams for explaining a liquid jet head 1 according to a first embodiment of the present invention. FIG. 1 is a schematic partial perspective view of the liquid jet head 1, FIG. 2 is an exploded perspective view of the liquid jet head 1 illustrated in FIG. 1, FIG. 3A is a schematic plan view of an actuator substrate 2 from which a cover plate 3 has been removed, FIG. 3B is a schematic cross-sectional view taken along line AA (FIG. 3A), and FIG. 3C is a schematic cross-sectional view taken along line BB (FIG. 3A).

As illustrated in FIGS. 1 to 3C, the liquid jet head 1 includes the actuator substrate 2, the cover plate 3 provided on a top surface TS of the actuator substrate 2, and a nozzle plate 4 provided on a bottom surface BS of the actuator substrate 2. The actuator substrate 2 includes a first groove array 8*a* formed by alternately arraying a first ejection groove 6*a* and a first dummy groove 7*a*, a second groove array 8*b* parallel to the first groove array 8*a* and formed by alternately arraying a second ejection groove 6*b* and a second dummy groove 7*b*, and a common chamber 9 which is provided between the first groove array 8*a* and the second groove array 8*b* and communicates with respective one ends CE of the first and second ejection grooves 6*a*, 6*b*.

The first and second ejection grooves 6*a*, 6*b* are formed in an area from the common chamber 9 to the vicinity of outer peripheral ends of the actuator substrate 2 in a groove direction (x direction) intersecting an array direction (y direction) of the first or second groove array 8*a*, 8*b*. The first and second dummy grooves 7*a*, 7*b* are formed in an area from the outer peripheral ends of the actuator substrate 2 to the vicinity of the common chamber 9. All of the first and second ejection grooves 6*a*, 6*b* and the first and second dummy grooves 7*a*, 7*b* penetrate from the top surface TS to the bottom surface BS. The first and second ejection grooves 6*a*, 6*b*, as well as the first and second dummy grooves 7*a*, 7*b*, have a symmetric configuration about the common chamber 9. Further, the first and second ejection grooves 6*a*, 6*b* are formed in alignment with the groove direction. All of the other ends LE, RE of the first and second ejection grooves 6*a*, 6*b* and end portions of the first and second dummy grooves 7*a*, 7*b* on the common chamber 9 side are tilted or circular-shaped. This is because the respective grooves are formed by using a disk-shaped dicing blade with diamond abrasive grains embedded in an outer peripheral portion thereof, thereby leaving an outer configuration of the dicing blade at the groove end portions.

It should be noted that in the present invention, it is not essential for the first and second dummy grooves 7*a*, 7*b* to penetrate from the top surface TS to the bottom surface BS of the actuator substrate 2. The first or second dummy groove 7*a*, 7*b* does not need to communicate with a nozzle, and the actuator substrate 2 may be left at a lower end portion thereof. By leaving the actuator substrate 2 at the lower end portions of the first and second dummy grooves 7*a*, 7*b*, the strength of the actuator substrate 2 can be secured when the first and second ejection grooves 6*a*, 6*b* or the first and second dummy grooves 7*a*, 7*b* are formed.

The cover plate 3 includes one chamber 10 communicating with the common chamber 9, a first chamber 10*a* communicating with the other end LE of the first ejection groove 6*a*, and a second chamber 10*b* communicating with the other end RE of the second ejection groove 6*b*. The cover plate 3 covers the common chamber 9, the first groove array 8*a*, and the second groove array 8*b* and is provided on the top surface TS of the actuator substrate 2 so as to expose outer peripheral portions thereof in the groove direction (x direction). The first and second chambers 10*a*, 10*b* are formed by recessed portions, from which surfaces have been removed, and are elongated in the array direction (y direction). The first and second chambers 10*a*, 10*b* communicate with the respective other ends LE, RE of the first and second ejection grooves 6*a*, 6*b* via slits 22*a*, 22*b* formed at bottom surfaces of the respective recessed portions. The top surfaces of the first and second dummy grooves 7*a*, 7*b* corresponding to the first and second chambers 10*a*, 10*b* are covered with the cover plate 3. The one chamber 10 has an elongated shape in the array direction and a reinforcing bridge 20 is provided in the middle of the one chamber 10 so as to cross the elongated shape. Here, the common chamber 9 and the one chamber 10 function as a liquid supply chamber or a liquid combining chamber.

The nozzle plate 4 includes a first nozzle 13*a* communicating with the first ejection groove 6*a* and a second nozzle 13*b* communicating with the second ejection groove 6*b*. The nozzle plate 4 is provided on the bottom surface BS of the actuator substrate 2 so as to block the common chamber 9, the first groove array 8*a*, and the second groove array 8*b*. With this configuration, the top surfaces of the first and second ejection grooves 6*a*, 6*b* are covered with the cover plate 3 and the bottom surfaces thereof are covered with the nozzle plate 4, thereby forming channels through which the liquid flows.

The liquid flows from the one chamber 10 into the common chamber 9, flows from the common chamber 9 into the individual first and second ejection grooves 6*a*, 6*b* in a divided manner, and flows out to the first chamber 10*a* and the second chamber 10*b* through the slits 22*a*, 22*b* corresponding to the respective ejection grooves 6*a*, 6*b*. Alternatively, the liquid flows into the first chamber 10*a* and the second chamber 10*b*, flows to the first and second ejection grooves 6*a*, 6*b* in a divided manner through the slits 22*a*, 22*b*, is combined in the common chamber 9, and flows out to the one chamber 10. The liquid does not flow into the first and second dummy grooves 7*a* and 7*b*. As a result, compared to the case where the liquid flows into the individual channels from the cover plate side and flows out from the individual channels to the cover plate side as in the conventional example, an inner volume of the liquid supply chamber or the liquid combining chamber increases due to the provision of the common chamber 9. By so doing, the common chamber 9 and the one chamber 10 (the liquid supply chamber or the liquid combining chamber) cannot have a gradient of flow path resistance in the array direction of the first and second nozzles 13*a*, 13*b*. This is because the liquid flows into the one chamber 10 and the common chamber 9 in the z direction and flows from the common chamber 9 into the first and second ejection grooves 6*a*, 6*b* in the x direction. In other words, the flow of liquid is more dominant in the z direction and the x direction than in the y direction, which is a longitudinal direction of the common chamber 9, making it difficult to generate the flow path resistance in the y direction. Accordingly, a difference in the flow path resistance between the ejection groove disposed at a central portion in the array direction and the ejection groove disposed at the end portion therein is reduced, and an ejection condition of the ejection groove disposed at the end portion and that of the ejection groove disposed at the central portion can be equalized.

It should be noted that in the present embodiment, the first chamber 10*a* and the second chamber 10*b* are formed with the surface of the cover plate 3, which is a single member, removed. However, the present invention is not limited to this structure. In other words, the cover plate 3 in the present invention may be structured by a single member or may be structured by a multilayer of a plurality of members. For example, it is possible that the slits 22*a*, 22*b* respectively communicating with the first and second ejection grooves 6*a*, 6*b* are formed on a first substrate, the first chamber 10*a* communicating with the slit 22*a* and the second chamber 10*b* communicating with the slit 22*b* are formed on a second substrate provided on the first substrate, and the laminated first substrate and second substrate serve as the cover plate 3.

Further, in the present embodiment, the first and second dummy grooves 7*a*, 7*b* open on end surfaces of the actuator substrate 2 in the groove direction. However, the present invention is not limited to this structure. The first and second dummy grooves 7*a*, 7*b* may be formed up to the vicinity of the end surfaces of the actuator substrate 2 in the groove direction and form closed spaces. It should be noted that since the first and second dummy grooves 7*a*, 7*b* are formed so as to open on the end surfaces of the actuator substrate 2 in the groove direction, it is easy to form an active terminal 17*b* to be described below. Moreover, the other ends LE, RE of the first and second ejection grooves 6*a*, 6*b* and the end portions of the first and second dummy grooves 7*a*, 7*b* on the common chamber 9 side are circular-shaped. When these grooves are formed by grinding with the dicing blade, by grinding these grooves deeper than the final depths thereof using the dicing blade, widths of the circular shapes in the groove direction can be made smaller. In this way, the number of the actuator substrates 2 that can be taken from one sheet of piezoelectric wafer can be increased.

A structure of electrodes is described using FIGS. 3A to 3C. As illustrated in FIG. 3A, common electrodes 16*a* electrically connected to each other are formed on both side surfaces of the first and second ejection grooves 6*a*, 6*b*, and active electrodes 16*b* electrically separated from each other are formed on both side surfaces of the first and second dummy grooves 7*a*, 7*b*. An active terminal 17*b* is provided between the adjacent first dummy grooves 7*a* with the first ejection groove 6*a* therebetween and on the top surface TS in the vicinity of the outer peripheral end of the actuator substrate 2. The active terminal 17*b* is electrically connected to the two active electrodes 16*b* which are formed on the side surfaces of the adjacent first dummy grooves 7*a* on the adjacent sides. A common terminal 17*a* electrically connected to the common electrodes 16*a* and electrically separated from the active terminal 17*b* is provided on the top surface TS of the actuator substrate 2 in the vicinity of the other end LE of the first ejection groove 6*a*. Likewise, the active terminal 17*b* is provided between the adjacent second dummy grooves 7*b* with the second ejection groove 6*b* therebetween and on the top surface TS in the vicinity of the outer peripheral end of the actuator substrate 2. The active terminal 17*b* is electrically connected to the two active electrodes 16*b* which are formed on the side surfaces of the adjacent second dummy grooves 7*b* on the adjacent sides. The common terminal 17*a* electrically connected to the common electrodes 16*a* and electrically separated from the active terminal 17*b* is provided on the top surface TS of the actuator substrate 2 in the vicinity of the other end RE of the second ejection groove 6*b*.

In other words, since the liquid is flowed from the other ends LE, RE of the first and second ejection grooves 6*a*, 6*b* to the first and second chambers 10*a*, 10*b* via the slits 22*a*, 22*b*, the first or second dummy groove 7*a*, 7*b* provided between the adjacent first or second ejection grooves 6*a*, 6*b* can be extended to the outer peripheral end of the actuator substrate 2. As a result, the active electrodes 16*b* formed on the side surfaces of the first or second dummy groove 7*a*, 7*b* can be easily pulled out on the top surface TS in the vicinity of the outer peripheral end of the actuator substrate 2.

As illustrated in FIG. 3B, the common electrode 16*a* is formed on substantially an upper half of each of the side surfaces of the first and second ejection grooves 6*a*, 6*b*. As illustrated in FIG. 3C, the active electrode 16*b* is formed on substantially an upper half of each of the side surfaces of the first and second dummy grooves 7*a*, 7*b*. Due to this electrode structure, when a drive signal is supplied to the common electrode 16*a* and the active electrode 16*b*, two side walls between the first or second ejection groove 6*a*, 6*b* and the first or second dummy groove 7*a*, 7*b* adjacent thereto are deformed in a thickness-shear mode and a pressure wave is generated in the liquid filling the first or second ejection groove 6*a*, 6*b*. Due to this pressure wave, droplets are ejected from the first or second nozzle 13*a*, 13*b* communicated with the first or second ejection groove 6*a*, 6*b*.

Normally, a GND potential is applied to each common terminal 17*a* and a groove drive signal is applied to each active terminal 17*b*. The first and second ejection grooves 6*a*, 6*b*, in which the common electrodes 16*a* are formed, are filled with liquid but the first and second dummy grooves 7*a*, 7*b*, in which the active electrodes 16*b* are formed, are not filled with the liquid. As a result, even if the common electrodes 16*a* contact the liquid, the common electrodes 16*a* in all of the ejection grooves have the same potential. Even if a conductive liquid is used, the liquid is not subjected to electrolysis, and the drive signal is not leaked via the conductive liquid. On the other hand, in JP 2009-532237 W, the liquid flows into all of the grooves and contacts both the high-voltage electrode and the low-voltage electrode. Accordingly, when the conductive liquid is used, it is necessary to coat the electrode surface with an insulating material and the structure becomes complicated.

It should be noted that in the present embodiment, the common electrode 16*a* and the active electrode 16*b* are formed up to substantially half the depth of the side surfaces. However, the present invention is not limited to this. It is possible that the actuator substrate 2 is formed by laminating two piezoelectric substrates subjected to a polarization treatment in directions opposite to each other and the common electrode 16*a* and the active electrode 16*b* are formed from an upper end portion to a lower end portion of a side surface.

In this way, since the common terminal 17*a* and the active terminal 17*b* are provided on the actuator substrate 2 on the side opposite to the nozzle plate 4, the thickness of a flexible substrate connected to the common terminal 17*a* or the active terminal 17*b* and the height of an adhesion portion when the flexible substrate is adhered to the top surface TS are not greatly limited.

Thus, in the present embodiment, description has been given of an example in which the first groove array 8*a* and the second groove array 8*b* are formed in the actuator substrate 2 with the common chamber 9 therebetween, the first chamber 10*a* and the second chamber 10*b* are formed on the cover plate 3 with the one chamber 10 therebetween, and the first nozzle 13*a* and the second nozzle 13*b* are formed on the nozzle plate 4. Instead of the above-described structure, the present invention can be the liquid jet head 1 only having either a left side or a right side including the one chamber 10 and the common chamber 9 of the liquid jet head 1.

In other words, the actuator substrate 2 includes the first groove array 8*a* (or the second groove array 8*b*) (the groove array) formed by alternately arraying the first ejection groove 6*a* (or the second ejection groove 6*b*) (the ejection groove) and the first dummy groove 7*a* (or the second dummy groove 7*b*) (the dummy groove), and the common chamber 9 communicating with the one end CE of the ejection groove. The cover plate 3 includes the one chamber 10 communicating with the common chamber 9, the first chamber 10*a* (or the second chamber 10*b*) (the other chamber) communicating with the other end LE (or the other end RE) of the ejection groove, and is provided on the top surface TS of the actuator substrate 2 so as to cover the groove array. The nozzle plate 4 includes the first nozzle 13*a* (or the second nozzle 13*b*) (the nozzle) communicating with the ejection groove and is provided on the bottom surface BS of the actuator substrate 2 so as to cover the groove array.

Further, a structure in which the common electrodes 16*a* electrically connected to each other are formed on the both side surfaces of the ejection groove, the active electrodes 16*b* electrically separated from each other are formed on the both side surfaces of the dummy groove, the common terminal 17*a* and the active terminal 17*b* are formed on the top surface TS in the vicinity of the outer peripheral end of the actuator substrate 2, and the like is similar to the case of the first embodiment. Even with the structure of one nozzle array corresponding to one groove array, effects similar to those of the above-described first embodiment can be achieved.

Second Embodiment

Figure 4:
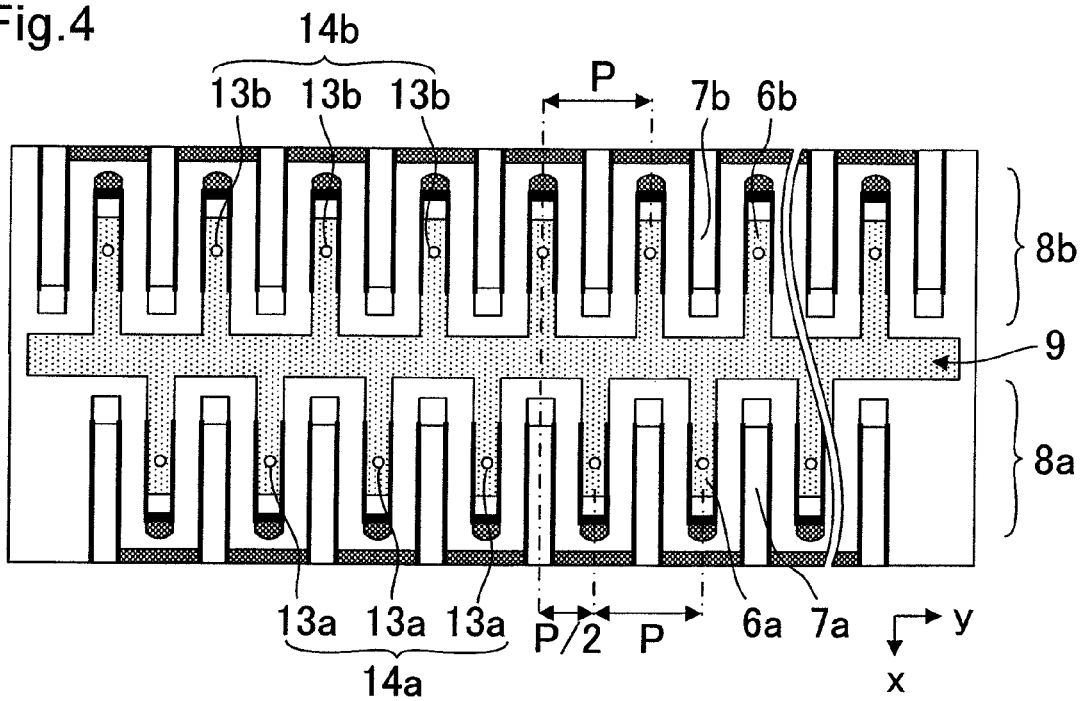
FIG. 4 is a schematic top view of a liquid jet head, from which a cover plate has been removed, according to a second embodiment of the present invention.

FIG. 4 is a schematic top view of a liquid jet head 1, from which a cover plate 3 has been removed, according to a second embodiment of the present invention. The second embodiment is different from the first embodiment in locations of a first ejection groove 6*a*, a second ejection groove 6*b*, a first dummy groove 7*a*, and a second dummy groove 7*b*. The other structures are similar to those of the first embodiment. What is different from the first embodiment will be mainly described below and description of the same structures is omitted. The same portions and the portions having the same function are denoted by the same reference numerals.

As illustrated in FIG. 4, an array direction (y direction) of a first or second groove array 8*a*, 8*b* is orthogonal to a groove direction (x direction) of the first or second ejection groove 6*a*, 6*b*. In the array direction of the first or second groove array 8*a*, 8*b*, a pitch P between the first ejection grooves 6*a* and that between the second ejection grooves 6*b* are equal and the first ejection groove 6*a* is deviated from the second ejection groove 6*b* by a P/2 pitch. The first dummy groove 7*a* and the second dummy groove 7*b* are also formed in the same way. Accordingly, the first ejection groove 6*a* of the first groove array 8*a* opposes the second dummy groove 7*b* of the second groove array 8*b* with the common chamber 9 therebetween, and the second ejection groove 6*b* of the second groove array 8*b* opposes the first dummy groove 7*a* of the first groove array 8*a* with the common chamber 9 therebetween. Further, in the array direction of the first or second groove array 8*a*, 8*b*, first nozzles 13*a* form a first nozzle array 14*a* and second nozzles 13*b* form a second nozzle array 14*b*. The pitch P between the first nozzles 13*a* and that between the second nozzles 13*b* are equal and the first nozzle 13*a* is deviated from the second nozzle 13*b* by a P/2 pitch. This can double a recording density in the array direction. The other effects are similar to those of the first embodiment.

Third Embodiment

Figure 5:
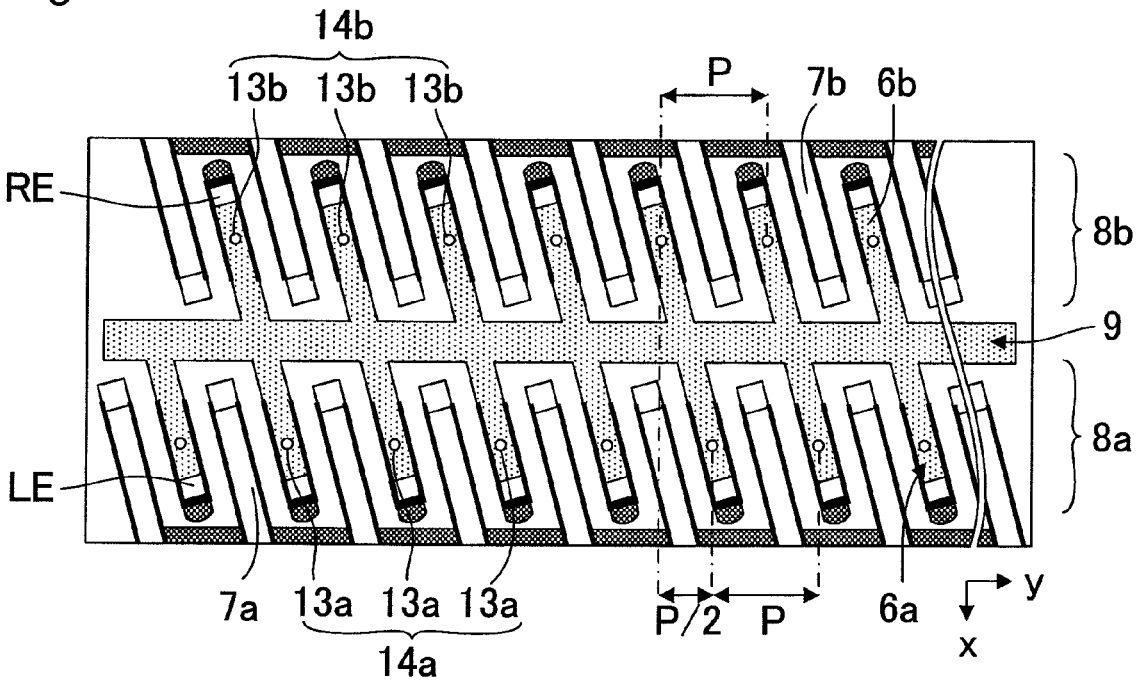
FIG. 5 is a schematic top view of a liquid jet head, from which a cover plate has been removed, according to a third embodiment of the present invention.

FIG. 5 is a schematic top view of a liquid jet head 1, from which a cover plate 3 has been removed, according to a third embodiment of the present invention. The third embodiment is different from the first embodiment in that groove directions of a first ejection groove 6*a* and a second ejection groove 6*b*, which are formed linearly, are inclined relative to an array direction of the first or second groove array 8*a*, 8*b*. The other structures are similar to those of the first embodiment. What is different from the first embodiment will be mainly described below and description of the same structures is omitted. The same portions and the portions having the same function are denoted by the same reference numerals.

As illustrated in FIG. 5, the first ejection groove 6*a* and the second ejection groove 6*b* are formed linearly with the common chamber 9 therebetween, and the groove directions of the first and second ejection grooves 6*a*, 6*b* are inclined relative to the array directions of the first and second groove arrays 8*a*, 8*b*. Likewise, groove directions of the first and second dummy grooves 7*a*, 7*b* are inclined relative to the array directions of the first and second groove arrays 8*a*, 8*b*. In the array direction of the first or second groove array 8*a*, 8*b*, first nozzles 13*a* form a first nozzle array 14*a* and second nozzles 13*b* form a second nozzle array 14*b*. A pitch P between the first nozzles 13*a* is equal to that between the second nozzles 13*b*, and the first nozzle 13*a* is deviated from the second nozzle 13*b* by a P/2 pitch. As a result, a recording density in the array direction can be doubled. Further, the first ejection groove 6*a* and the second ejection groove 6*b* can be formed continuously by a dicing blade or the like. The other effects are similar to those of the first embodiment.

It should be noted that in the present embodiment, the first ejection groove 6*a*, the second ejection groove 6*b*, the first dummy groove 7*a*, and the second dummy groove 7*b* are inclined linearly relative to the array direction with the common chamber 9 therebetween. However, the present invention is not limited to this. For example, the first and second groove arrays 8*a*, 8*b* may have different inclination angles. Alternatively, it is possible that the first groove array 8*a* is inclined as illustrated in FIG. 5 in such a manner that another end LE is formed in a +x direction and a +y direction and that the second groove array 8*b* is inclined opposite to the inclination direction illustrated in FIG. 5 in such a manner that another end RE is formed in a −x direction and a −y direction.

Fourth Embodiment

Figure 6:
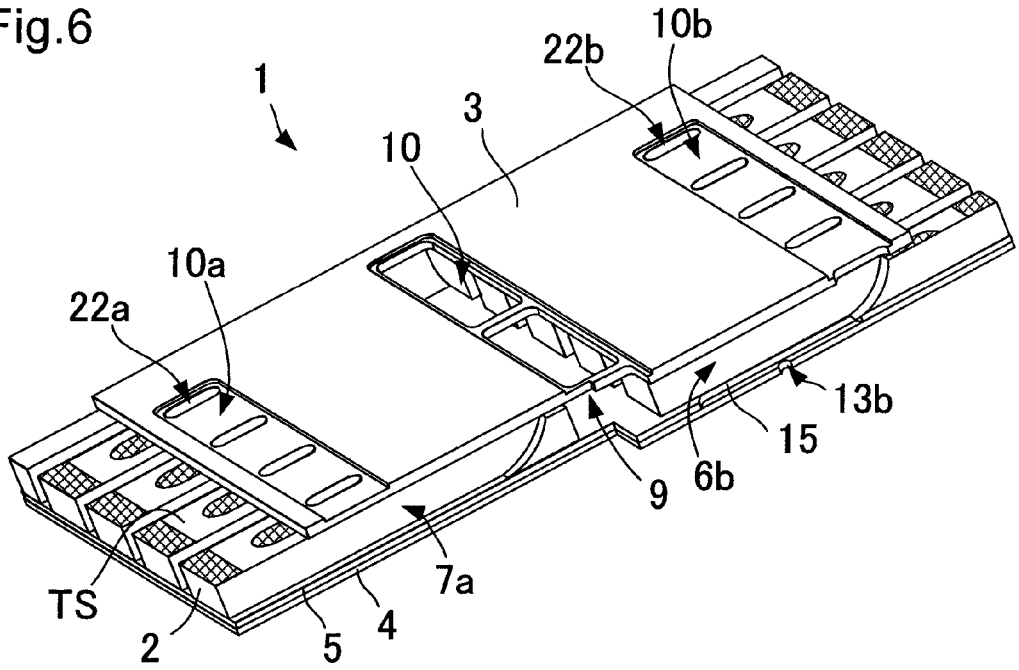
FIG. 6 is a schematic partial perspective view of a liquid jet head according to a fourth embodiment of the present invention.
Figure 7:
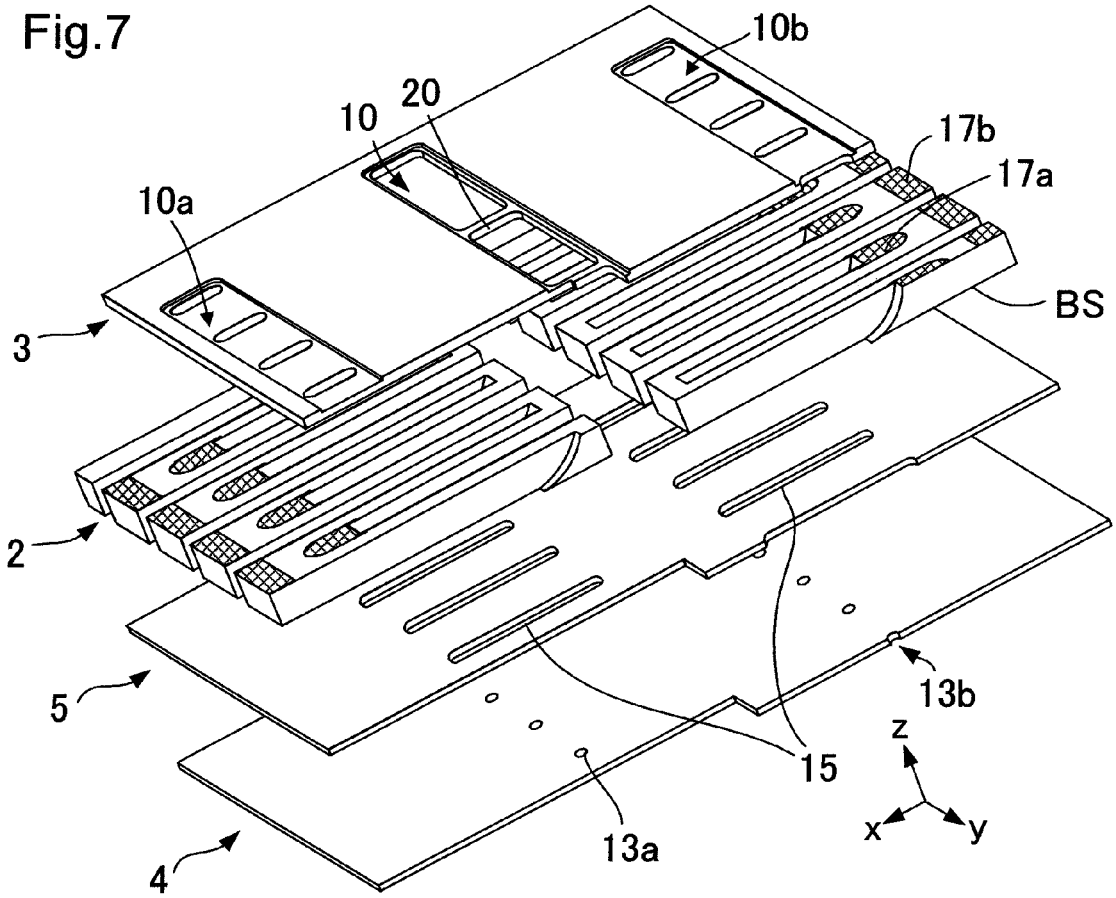
FIG. 7 is a schematic exploded perspective view of the liquid jet head according to the fourth embodiment of the present invention.

FIGS. 6 and 7 are diagrams for explaining a liquid jet head 1 according to a fourth embodiment of the present invention. FIG. 6 is a schematic partial perspective view of the liquid jet head 1, and FIG. 7 is a schematic exploded perspective view of the liquid jet head 1 illustrated in FIG. 6. The fourth embodiment is different from the first embodiment in that a reinforcing plate 5 is inserted between an actuator substrate 2 and a nozzle plate 4. The other structures are similar to those of the first embodiment. What is different from the first embodiment will be described below and description of the same structures is omitted. The same portions and the portions having the same function are denoted by the same reference numerals.

As illustrated in FIGS. 6 and 7, the liquid jet head 1 has a laminate structure obtained by laminating a cover plate 3, the actuator substrate 2, the reinforcing plate 5, and the nozzle plate 4. The reinforcing plate 5 is provided between a bottom surface BS of the actuator substrate 2 and the nozzle plate 4, and through holes 15 which penetrate in a plate thickness direction are formed at positions corresponding to first and second nozzles 13*a*, 13*b*. A ceramic material or a metal material having stiffness higher than that of the nozzle plate 4 can be used for the reinforcing plate 5. The through hole 15 has a shape which is larger than an opening diameter of the first or second nozzle 13*a*, 13*b* and is slightly smaller than a lower opening shape of the first or second ejection groove 6*a*, 6*b*. Preferably, the longitudinal direction of the through hole 15 is a longitudinal direction (x direction) of the ejection groove which is a liquid flowing direction. More preferably, an opening portion of the through hole 15 has a tapered shape which inclines from the actuator substrate 2 side toward the nozzle plate 4 side. In this way, accumulation of bubbles mixed into the liquid can be prevented. Further, by providing the reinforcing plate 5, upper end portions of movable walls which are both side walls of the ejection groove are fixed by the cover plate 3 and lower end portions thereof are fixed by the reinforcing plate 5. In this way, a drive voltage or a drive condition cannot be influenced by a material or a plate thickness of the nozzle plate 4. The other effects are similar to those of the first embodiment.

Fifth Embodiment

Figure 8A:
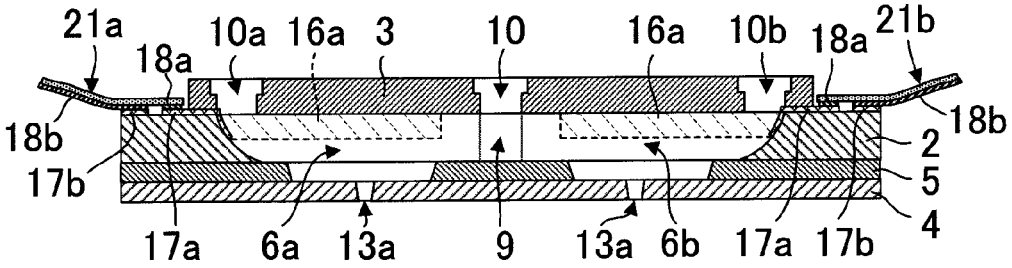
FIGS. 8A and 8B are diagrams for explaining a liquid jet head according to a fifth embodiment of the present invention.
Figure 8B:
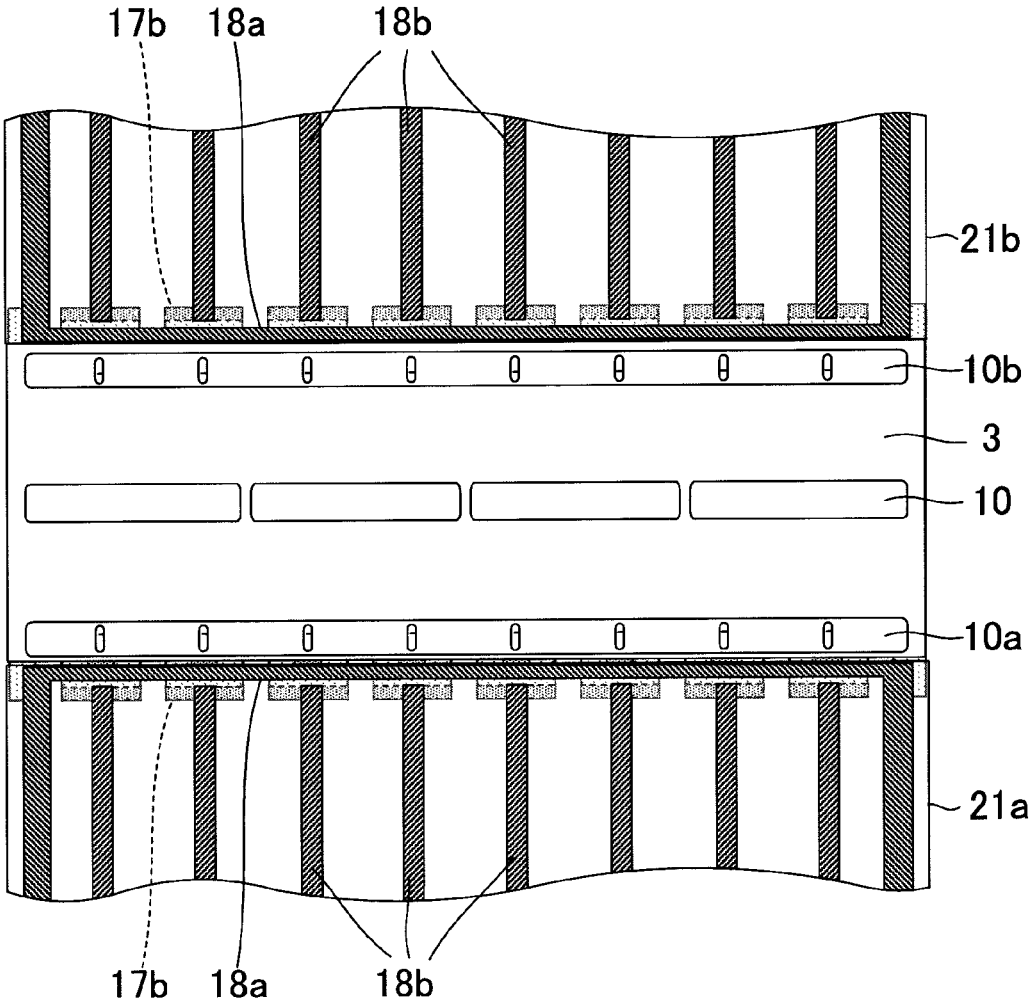

FIGS. 8A and 8B are diagrams for explaining a liquid jet head 1 according to a fifth embodiment of the present invention. FIG. 8A is a schematic cross-sectional view of the liquid jet head 1 in an ejection groove direction, and FIG. 8B is a schematic top view thereof. In the present embodiment, flexible substrates 21*a*, 21*b* are added to the laminate structure in the fourth embodiment formed by the cover plate 3, the actuator substrate 2, the reinforcing plate 5, and the nozzle plate 4. Accordingly, description of the laminate structure is omitted. The same portions and the portions having the same function are denoted by the same reference numerals.

In FIG. 8B, a common wiring 18*a* and an active wiring 18*b* formed on the flexible substrates 21*a*, 21*b* are formed on a surface on a paper rear side. A common terminal 17*a* and an active terminal 17*b* are provided on a top surface of an outer periphery of the actuator substrate 2 on a first ejection groove 6*a* side, and on a top surface of an outer periphery thereof on a second ejection groove 6*b* side. The active terminal 17*b* is formed on the top surface of an outermost periphery of the actuator substrate 2 and across adjacent dummy grooves. The common terminal 17*a* is formed from the ejection groove 6*a*, 6*b* to the vicinity of the active terminal 17*b*. Each of the flexible substrates 21*a*, 21*b* includes the common wiring 18*a* and the plurality of active wirings 18*b* and is bonded to the top surface of the actuator substrate 2. The common wiring 18*a* is electrically connected to the plurality of common terminals 17*a* and the plurality of active wirings 18*b* is electrically connected to the plurality of active terminals 17*b*, respectively. In this way, the same voltage, e.g., a GND potential, is applied to a plurality of common electrodes 16*a* and an individual drive signal is applied to a plurality of active electrodes.

It should be noted that the common wiring 18*a* intersects the first or second dummy groove 7*a*, 7*b* (see FIG. 3). As a result, by chamfering angular portions of the first and second dummy grooves 7*a*, 7*b* having intersecting portions where the first and second dummy grooves 7*a*, 7*b* and the common wiring 18*a* intersect and angular portions of a top surface TS, a short circuit between the active electrode 16*b* and the common wiring 18*a* can be prevented. Moreover, instead of chamfering the angular portions, it is possible that an area of the common wiring 18*a* corresponding to the common terminal 17*a* is exposed and areas of the common wiring 18*a* intersecting the first and second dummy grooves 7*a*, 7*b* are covered with an insulating film. Since the flexible substrates 21*a*, 21*b* are provided on the top surface TS of the actuator substrate 2 in this way, thicknesses thereof are not limited. The other effects are similar to those of the fourth embodiment.

The third to fifth embodiments have been described above in which the liquid jet head 1 has two groove arrays, i.e., the first groove array 8*a* and the second groove array 8*b*. However, as described last in the first embodiment, the liquid jet head 1 can only have one groove array, which is either a left side or a right side including one chamber 10 and a common chamber 9 of the liquid jet head 1. In the fourth and fifth embodiments, it is obvious that the effects of the original embodiment can be achieved even in a case of the one groove array.

<Liquid Jet Apparatus>

Sixth Embodiment

Figure 9:
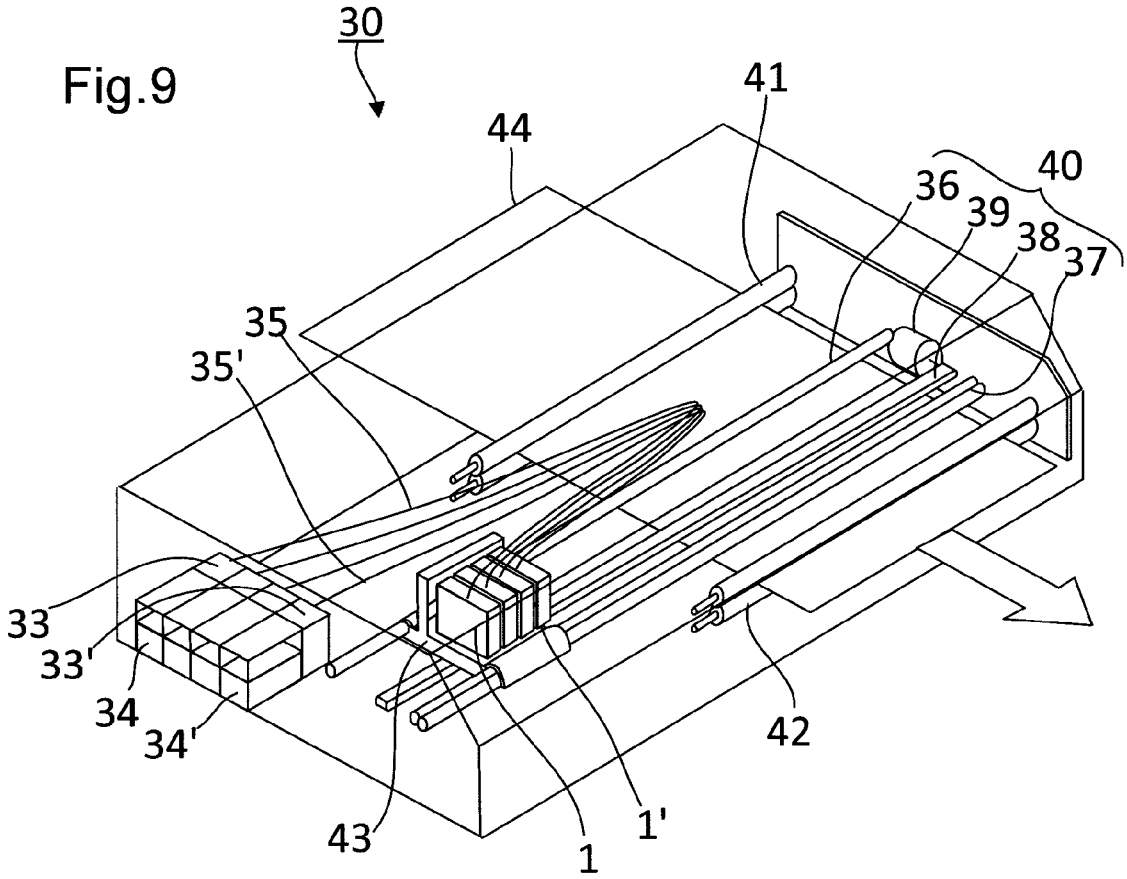
FIG. 9 is a schematic perspective view of a liquid jet apparatus according to a sixth embodiment of the present invention.

FIG. 9 is a schematic perspective view of a liquid jet apparatus 30 according to a sixth embodiment of the present invention. The liquid jet apparatus 30 includes a moving mechanism 40 for reciprocating liquid jet heads 1, 1', flow path sections 35, 35' for supplying liquid to the liquid jet heads 1, 1' and discharging the liquid from the liquid jet heads 1, 1', and liquid pumps 33, 33' and liquid tanks 34, 34' for supplying the liquid to the flow path sections 35, 35'. The liquid jet head of the present invention can be used as the liquid jet heads 1, 1' and, for example, any one of the first to fifth embodiments can be applied thereto. In other words, each of the liquid jet heads 1, 1' includes first and second groove arrays, the first and second groove arrays respectively include a plurality of first and second ejection grooves, and droplets are ejected from first and second nozzle arrays.

The liquid jet apparatus 30 includes a pair of conveyance units 41, 42 for conveying a recording medium 44, such as paper, in a main scanning direction, the liquid jet heads 1, 1' for ejecting the liquid to the recording medium 44, a carriage unit 43 on which the liquid jet heads 1, 1' are mounted, the liquid pumps 33, 33' for pressing and supplying the liquid stored in the liquid tanks 34, 34' to the flow path sections 35, 35', and the moving mechanism 40 for scanning the liquid jet heads 1, 1' in a sub-scanning direction orthogonal to the main scanning direction. A control section (not illustrated) controls and drives the liquid jet heads 1, 1', the moving mechanism 40, and the conveyance units 41, 42.

The pair of conveyance units 41, 42 extends in the sub-scanning direction and each includes a grid roller and a pinch roller which rotate with roller surfaces thereof in contact with each other. The grid roller and the pinch roller are rotated around shafts by a motor (not illustrated) and the recording medium 44 held between the rollers is conveyed in the main scanning direction. The moving mechanism 40 includes a pair of guide rails 36, 37 which extends in the sub-scanning direction, the carriage unit 43 which is slidable along the pair of guide rails 36, 37, an endless belt 38 to which the carriage unit 43 is coupled and which moves the carriage unit 43 in the sub-scanning direction, and a motor 39 for circling this endless belt 38 via a pulley (not illustrated).

The plurality of liquid jet heads 1, 1' is mounted on the carriage unit 43, which ejects four kinds of droplets, e.g., yellow, magenta, cyan, and black. The liquid tanks 34, 34' store the liquids having corresponding colors and supply the liquids to the liquid jet heads 1, 1' via the liquid pumps 33, 33' and the flow path sections 35, 35'. Each of the liquid jet heads 1, 1' ejects droplets of each color according to a drive signal. By controlling a timing at which the liquid is ejected from the liquid jet heads 1, 1', rotation of the motor 39 driving the carriage unit 43, and a conveyance speed of the recording medium 44, any pattern can be recorded on the recording medium 44.

It should be noted that the present embodiment is the liquid jet apparatus 30 in which the moving mechanism 40 moves the carriage unit 43 and the recording medium 44 for recording. However, in place of this, it is possible to employ the liquid jet apparatus in which the carriage unit is fixed and the moving mechanism moves the recording medium two-dimensionally for recording. In other words, any moving mechanism can be employed as long as the liquid jet head and the recording medium are moved relatively.

<Method of Manufacturing Liquid Jet Head>

Figure 10:
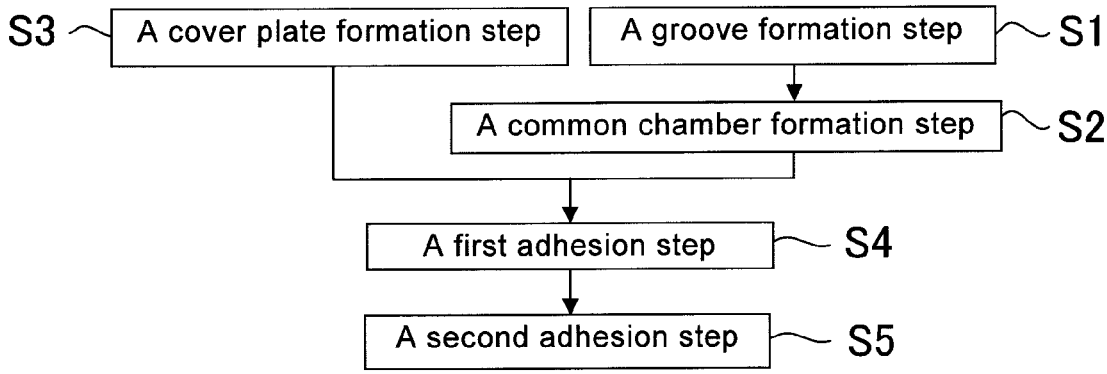
FIG. 10 is a process chart of a basic method of manufacturing a liquid jet head according to an embodiment of the present invention.

FIG. 10 is a process chart of a basic method of manufacturing a liquid jet head 1 according to an embodiment of the present invention. As illustrated in FIG. 10, first, in a groove formation step S1, a first groove array formed by arraying first ejection grooves and a second groove array formed by arraying second ejection grooves are formed in parallel on an actuator substrate including a piezoelectric body. It is preferable that a plate thickness of the actuator substrate be larger than a final depth of the ejection groove and that the actuator substrate be left at a groove bottom of the ejection groove so as to maintain the substrate strength. A laminate substrate, in which the piezoelectric body is laminated on a non-piezoelectric body, may be used as the actuator substrate. Alternatively, the actuator substrate may be structured in such a manner that an area of the first and second groove arrays is a piezoelectric body and the other area is a non-piezoelectric body. PZT ceramics is used as the piezoelectric body, and a substrate surface is previously subjected to a polarization treatment in a direction perpendicular thereto.

Next, in a common chamber formation step S2, a common chamber, which is disposed between the first groove array and the second groove array and communicates with each one end of the first and second ejection grooves, is formed at the actuator substrate. It is preferable to grind the common chamber at approximately the same depth as the first and second ejection grooves, to leave the actuator substrate at a groove bottom as in the ejection groove, and to maintain the substrate strength.

Further, in a cover plate formation step S3, one chamber, and a first chamber and a second chamber with this one chamber therebetween are formed at the cover plate. It is preferable to use, for the cover plate, a material having approximately the same coefficient of linear expansion as the actuator substrate. The same piezoelectric body as the actuator substrate can be used for the cover plate. Moreover, machinable ceramics or other materials can be used besides the piezoelectric body.

Next, in a first adhesion step S4, the cover plate is adhered to a top surface of the actuator substrate. Here, the one chamber is communicated with the common chamber, the first chamber is communicated with another end of the first ejection groove, and the second chamber is communicated with another end of the second ejection groove. In this way, the one chamber and the common chamber constitute one liquid supply chamber or one liquid combining chamber, and an inner volume thereof increases compared to a case where only the one chamber constitutes a liquid supply chamber or a liquid combining chamber. Next, a bottom surface of the actuator substrate on a side opposite to the cover plate is ground and groove bottoms of the first ejection groove, the second ejection groove, and the common chamber are opened.

Next, in a second adhesion step S5, a nozzle plate is adhered to a bottom surface of the actuator substrate. The nozzle plate includes a first nozzle and a second nozzle, and the first nozzle is communicated with the first ejection groove and the second nozzle is communicated with the second ejection groove. The first and second nozzles may be formed either before or after adhering the nozzle plate to the bottom surface of the actuator substrate. A polyimide resin film can be used for the nozzle plate.

In this way, by forming the common chamber communicated with the respective ejection grooves at the actuator substrate, the common chamber 9 and the one chamber 10 (the liquid supply chamber or the liquid combining chamber) cannot have a gradient of flow path resistance in an array direction of the first and second nozzles 13*a*, 13*b* (see FIGS. 1 to 3). This is because the liquid flows into the one chamber 10 and the common chamber 9 in the z direction and flows from the common chamber 9 into the first and second ejection grooves 6*a*, 6*b* in the x direction. In other words, the flow of liquid is more dominant in the z direction and the x direction than in the y direction, which is a longitudinal direction of the common chamber 9, and it is difficult to generate the flow path resistance in the y direction. Accordingly, a difference in the flow path resistance between the respective ejection grooves is decreased, and an ejection condition is equalized. Further, the ejection grooves are normally formed by using a disk-shaped dicing blade. An outer configuration of the dicing blade is left at a cut-out inclined portion of each groove, thereby increasing the length of the actuator substrate in a groove direction. In the present invention, since the ejection groove is formed deeper than the final depth thereof in the ejection groove formation step, this cut-out inclined portion can be formed short. By so doing, the number of actuator substrates that can be taken from a wafer can be increased and the cost of manufacturing the liquid jet head can be remarkably reduced.

Seventh Embodiment

Figure 11:
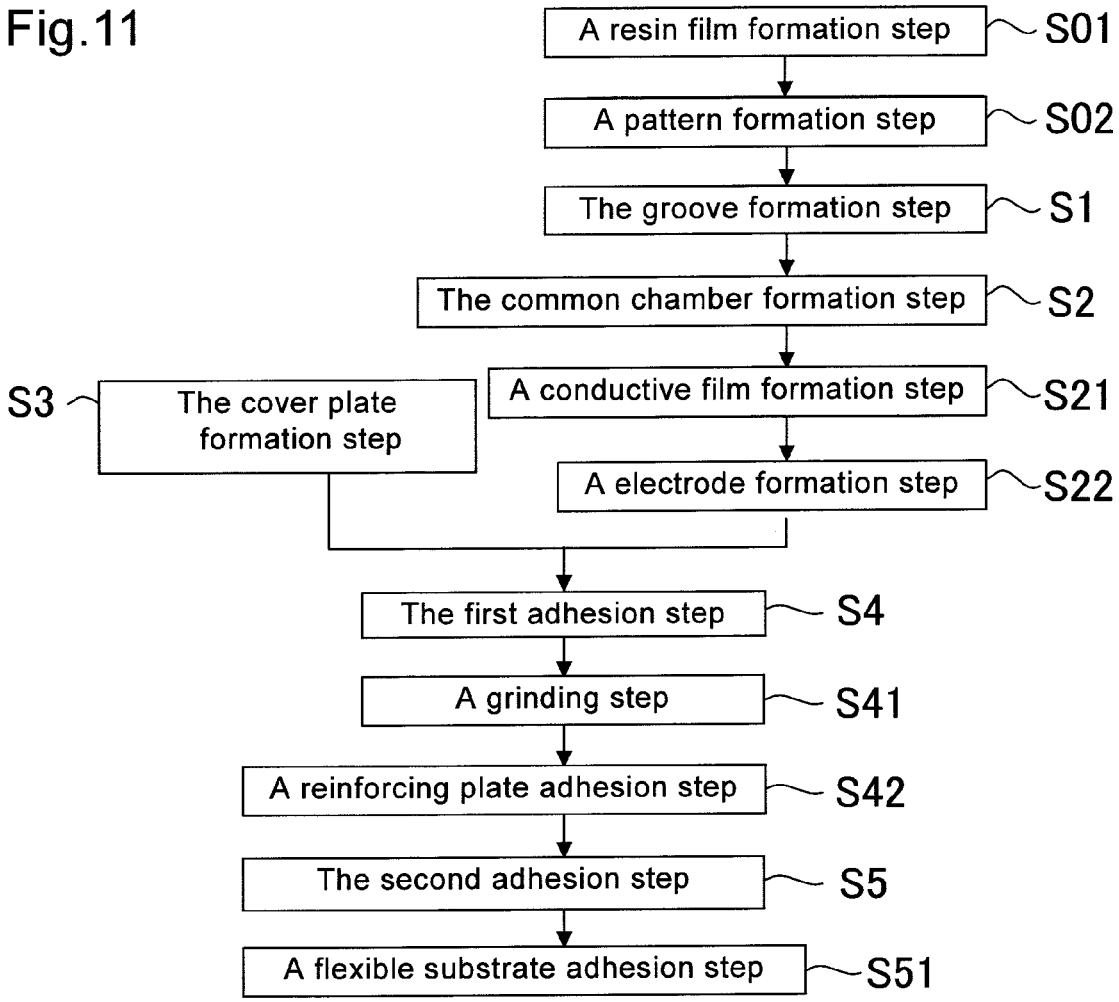
FIG. 11 is a process chart of a method of manufacturing a liquid jet head according to a seventh embodiment of the present invention.

A method of manufacturing a liquid jet head 1 according to a seventh embodiment of the present invention will be described using FIGS. 11 to 19. FIG. 11 is a process chart of the method of manufacturing the liquid jet head 1 according to the present embodiment. FIGS. 12 to 19 are diagrams for explaining each step. The same portions and the portions having the same function are denoted by the same reference numerals.

FIG. 12 is a schematic cross-sectional view of an actuator substrate 2 for explaining a resin film formation step S01 and a pattern formation step S02. First, the actuator substrate 2, which includes a piezoelectric body having a thickness greater than a depth of an ejection groove or a common chamber, is prepared. In the present embodiment, the entire actuator substrate 2 is formed of the piezoelectric body. PZT ceramics is used as the actuator substrate 2 and is subjected to a polarization treatment in a direction perpendicular to a substrate surface. It should be noted that a laminate plate obtained by laminating a piezoelectric substrate and a non-piezoelectric substrate, each having a thickness equal to the depth of the ejection groove, can be used as the actuator substrate 2. Further, a composite substrate, in which only an area where the ejection grooves are formed is a piezoelectric body and the other area is a non-piezoelectric body, can be used as the actuator substrate 2.

Figure 12A:
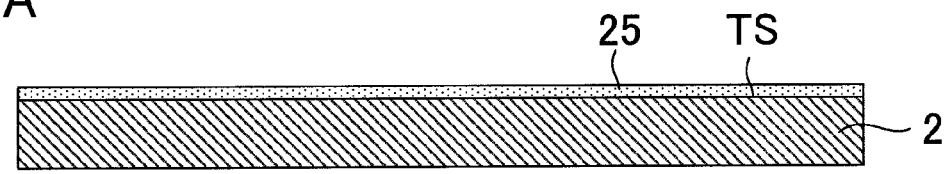
FIGS. 12A and 12B are diagrams for explaining the method of manufacturing a liquid jet head according to the seventh embodiment of the present invention.
Figure 12B:
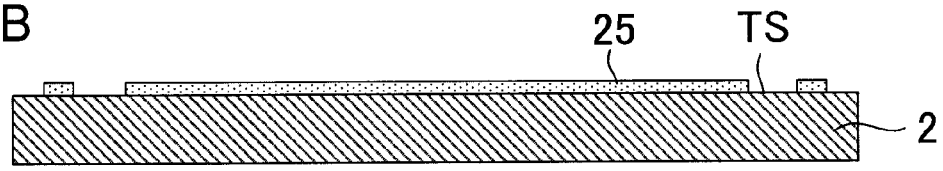

In the resin film formation step S01, as illustrated in FIG. 12A, a photosensitive resin 25, e.g., a resist film, is applied to a top surface TS of the actuator substrate 2 and then dried. Next, in the pattern formation step S02, as illustrated in FIG. 12B, the photosensitive resin 25 is exposed and developed and a pattern of the photosensitive resin 25 is formed. After that, areas of the photosensitive resin 25 where common terminals and active terminals are formed are removed, and the pattern is formed while leaving areas of the photosensitive resin 25 where electrodes are not formed.

Figure 13A:
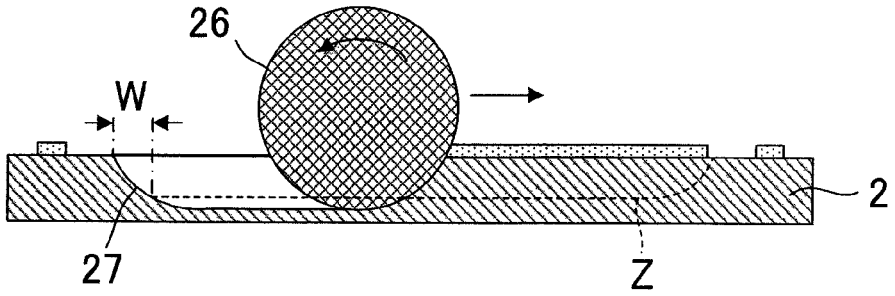
FIGS. 13A and 13B are diagrams for explaining the method of manufacturing a liquid jet head according to the seventh embodiment of the present invention.
Figure 13B:
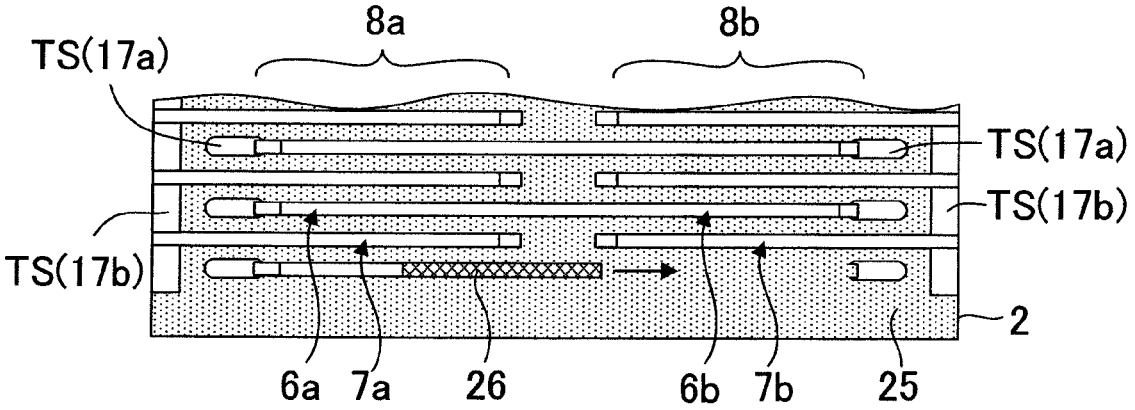

FIGS. 13A and 13B are diagrams for explaining the groove formation step S1. FIG. 13A is a schematic cross-sectional view of the actuator substrate 2 and FIG. 13B is a schematic plan view of the actuator substrate 2. In the groove formation step S1, a first groove array 8*a* formed by alternately arraying a first ejection groove 6*a* and a first dummy groove 7*a*, and a second groove array 8*b* formed by alternately arraying a second ejection groove 6*b* and a second dummy groove 7*b* are formed in the actuator substrate 2 in parallel using a dicing blade 26. Actually, the dicing blade 26 is lowered to an end portion of an area which later becomes a common terminal 17*a* of the first groove array 8*a* and is raised after horizontally grinding to an end portion of an area which becomes a common terminal 17*a* of the second groove array 8*b*. Consequently, the first and second ejection grooves 6*a*, 6*b* are continuously formed. Further, the dicing blade 26 horizontally grinds an area from an outer peripheral end of the actuator substrate 2 to the vicinity of an area which later becomes a common chamber, thereby forming the first and second dummy grooves 7*a*, 7*b*.

In the groove formation step S1, each groove is formed at a depth which does not reach a bottom surface of the actuator substrate 2 on a side opposite to a top surface TS. In other words, each groove is ground such that a depth thereof is larger than a final groove depth illustrated by a dashed line Z and a groove bottom remains without penetrating a bottom surface. By increasing the depth of the groove, a horizontal width W of a cut-out inclined portion 27 can be made smaller. For example, when a groove having a depth of 360 μm is formed using the two-inch dicing blade 26, the width W of the cut-out inclined portion 27 becomes approximately 4 mm. On the other hand, when a groove having a depth of 590 μm is formed using the same dicing blade 26, the width W of the cut-out inclined portion 27 to the depth of 360 μm is approximately 2 mm, that is, can be reduced by half. In other words, the width can be reduced by a total of 8 mm at the four cut-out inclined portions 27 per actuator substrate (one ends LE, RE of the first and second ejection grooves 6*a*, 6*b* and two end portions of the first and second dummy grooves 7*a*, 7*b* on the common chamber 9 side), thereby remarkably increasing the number of actuator substrates that can be taken from a piezoelectric wafer.

Figure 14:
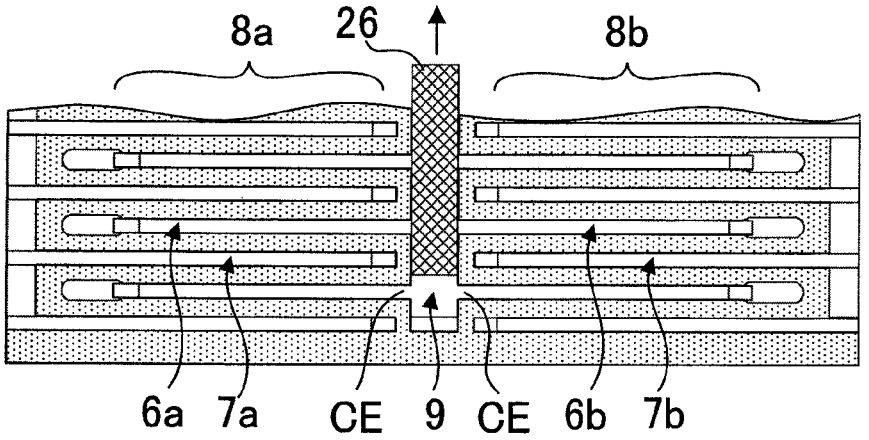
FIG. 14 is a diagram for explaining the method of manufacturing a liquid jet head according to the seventh embodiment of the present invention.

FIG. 14 is a schematic top view of the actuator substrate 2 for explaining the common chamber formation step S2. In the common chamber formation step S2, a common chamber 9, which is disposed between the first groove array 8*a* and the second groove array 8*b* and communicates with one ends CE of the first and second ejection grooves 6*a*, 6*b*, is formed in the actuator substrate 2. A groove depth of the common chamber 9 is the same as the depth of the first or second ejection groove 6*a*, 6*b*. If the wide dicing blade 26 is used, the common chamber 9 can be formed in a short time. In this case as well, the common chamber 9 is ground so as to leave and not penetrate a groove bottom.

Figure 15A:
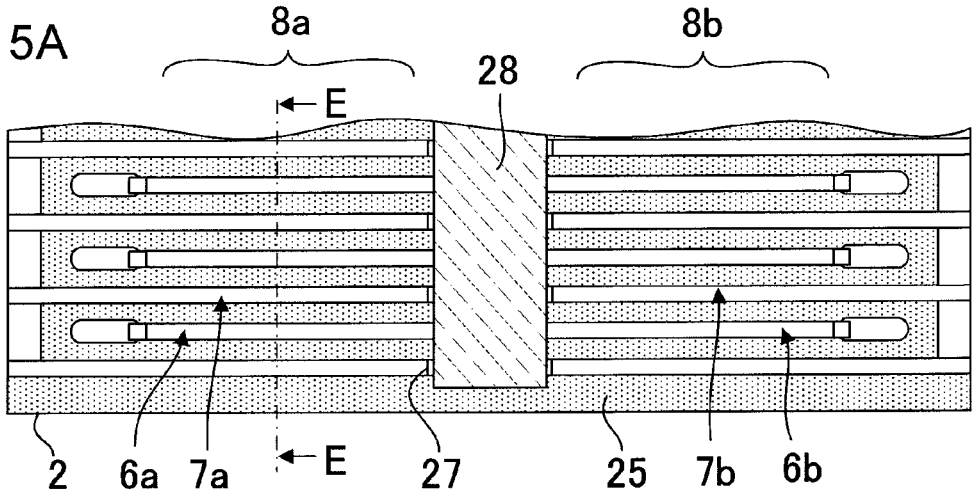
FIGS. 15A to 15D are diagrams for explaining the method of manufacturing a liquid jet head according to the seventh embodiment of the present invention.
Figure 15B:
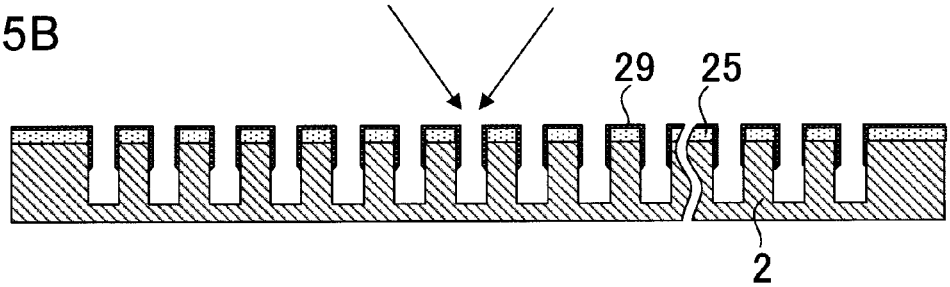
Figure 15C:
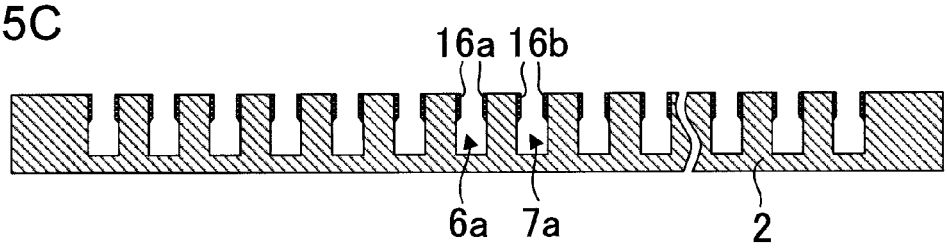
Figure 15D:
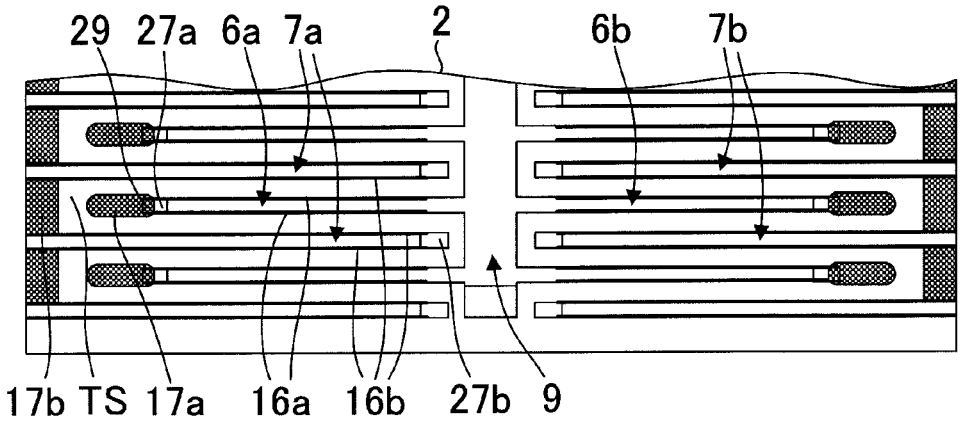

FIGS. 15A to 15D are diagrams for explaining a conductive film formation step S21 and an electrode formation step S22. FIG. 15A is a schematic partial plan view illustrating a mask provided on a surface of the actuator substrate 2. FIG. 15B is a schematic cross-sectional view of the actuator substrate 2 taken along line EE illustrating a condition where a conductive material is vapor-deposited in oblique directions. FIG. 15C is a schematic cross-sectional view illustrating an electrode pattern formed by removing the photosensitive resin 25. FIG. 15D is a schematic partial top view of the actuator substrate 2.

As illustrated in FIG. 15A, in the conductive film formation step S21, a mask 28 covering the common chamber 9, end portions of the first and second dummy grooves 7*a*, 7*b* on the common chamber 9 side, and end portions of the first and second ejection grooves 6*a*, 6*b* on the common chamber 9 side is provided. More specifically, the mask 28 is provided on a top surface of the actuator substrate 2 so as to cover the common chamber 9 and half or more of each of the cut-out inclined portions 27 at the end portions of the first and second dummy grooves 7*a*, 7*b* on the common chamber 9 side. Next, as illustrated in FIG. 15B, a conductive body is vapor-deposited on the top surface of the actuator substrate 2 in oblique directions (oblique deposition) orthogonal to a groove direction, thereby forming a conductive film 29. In other words, the conductive film 29 is formed on substantially the upper half of each final groove depth of the first and second ejection grooves 6*a*, 6*b* and the first and second dummy grooves 7*a*, 7*b*. A metal material such as aluminum, nickel, or chromium, or a semiconductor material can be used as the conductive film 29.

Next, in the electrode formation step S22, as illustrated in FIG. 15C, according to a lift-off method of removing the photosensitive resin 25, common electrodes 16*a* are formed on both side surfaces of the first and second ejection grooves 6*a*, 6*b* and active electrodes 16*b* are formed on both side surfaces of the first and second dummy grooves 7*a*, 7*b*. Further, as illustrated in FIG. 15D, an active terminal 17*b* is formed on the top surface TS of an outer periphery of the actuator substrate 2 in the groove direction and a common terminal 17*a* is formed on the top surface TS between the active terminal 17*b* and the ejection groove (the first or second ejection groove 6*a*, 6*b*). The common terminal 17*a* is electrically connected to the common electrodes 16*a* formed on the both side surfaces of the ejection groove (the first or second ejection groove 6*a*, 6*b*) via the conductive film 29 formed on the upper half of a cut-out inclined portion 27*a*. The active terminal 17*b* is electrically connected to the active electrodes 16*b* formed on the side surfaces of the two dummy grooves (the first or second dummy groove 7*a*, 7*b*) on the ejection groove side with the ejection groove therebetween. Since the conductive film 29 is not formed on the upper half of a cut-out inclined portion 27*b* of the dummy groove due to the effect of the mask 28, the two active electrodes 16*b* formed on the both side surfaces of the dummy groove are electrically separated. Needless to say, the common terminal 17*a* and the active terminal 17*b* formed at each of the first and second groove arrays 8*a*, 8*b* are also separated by the mask 28.

It should be noted that the common chamber 9 may be formed in the common chamber formation step S2 before the grooves, such as the first and second ejection grooves 6*a*, 6*b*, are formed in the groove formation step S1 or that the common chamber 9 may be formed in the common chamber formation step S2 after the electrode formation step S22.

Figure 16A:
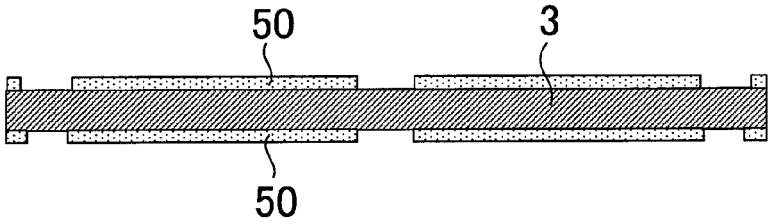
FIGS. 16A to 16C are diagrams for explaining the method of manufacturing a liquid jet head according to the seventh embodiment of the present invention.
Figure 16B:
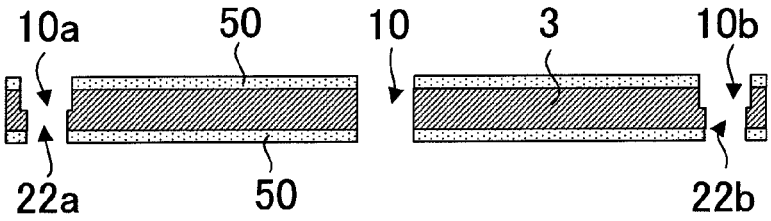
Figure 16C:
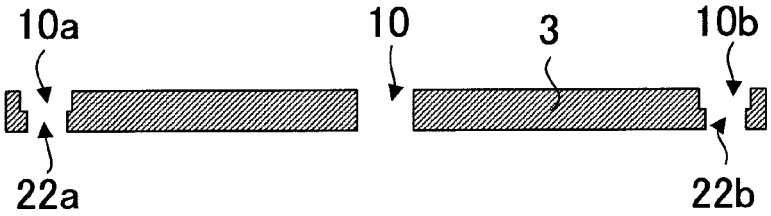

FIGS. 16A to 16C are schematic cross-sectional views of a cover plate 3 for explaining the cover plate formation step S3. As illustrated in FIG. 16A, a resin film 50 is formed on the top surface of the cover plate 3 so as to expose an area of the one chamber 10 and areas of first and second chambers 10*a*, 10*b* with this one chamber 10 therebetween, and another resin film 50 is formed on the bottom surface of the cover plate 3 so as to expose an area of the one chamber 10 and areas of slits 22*a*, 22*b* to be respectively communicated with the first and second chambers 10*a*, 10*b*. A pattern of the resin film 50 may be formed by applying the photosensitive film and carrying out exposure and development or may be formed according to a printing method. Next, as illustrated in FIG. 16B, the cover plate 3 is ground from the top and bottom surfaces according to a sandblasting method, the first and second chambers 10*a*, 10*b* are communicated with the slits 22*a*, 22*b*, respectively, and the one chamber 10 penetrating in a plate thickness direction is formed. Then, as illustrated in FIG. 16C, the resin film 50 is removed. PZT ceramics, which is the same material as the actuator substrate 2, is used for the cover plate 3 so as to prevent deformation or a crack caused by a difference in thermal expansion. It should be noted that in place of the PZT ceramics, a material having a coefficient of thermal expansion closer to that of the actuator substrate 2 can be used.

Figure 17A:
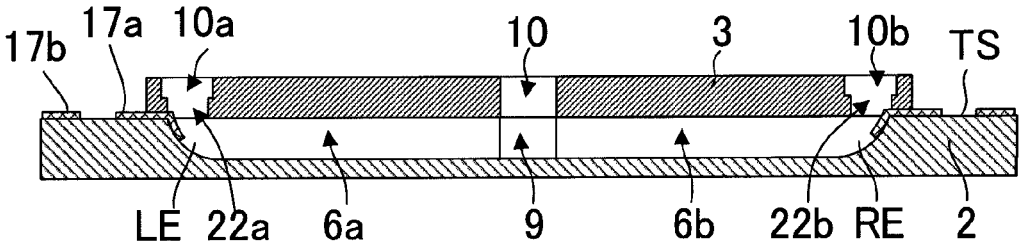
FIGS. 17A and 17B are diagrams for explaining the method of manufacturing a liquid jet head according to the seventh embodiment of the present invention.
Figure 17B:
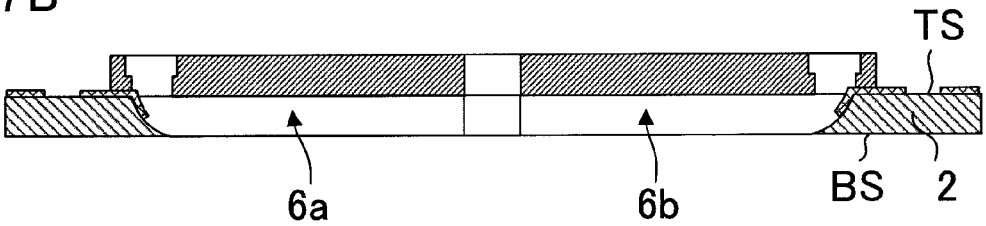

FIGS. 17A and 17B are schematic cross-sectional views for explaining the first adhesion step S4 and a grinding step S41. In the first adhesion step S4, as illustrated in FIG. 17A, the cover plate 3 is adhered to the top surface TS of the actuator substrate 2 with an adhesive. At this time, the one chamber 10 communicates with the common chamber 9, the first chamber 10*a* communicates with another end LE of the first ejection groove 6*a* via the slit 22*a*, and the second chamber 10*b* communicates with another end RE of the second ejection groove 6*b* via the slit 22*b*. The cover plate 3 is formed smaller than an outer shape of the actuator substrate 2 in the groove direction so as to expose the common terminal 17*a* and the active terminal 17*b*. Next, in the grinding step S41, as illustrated in FIG. 17B, the bottom surface of the actuator substrate 2 is ground and the groove bottoms of the first and second ejection grooves 6*a*, 6*b* and the first and second dummy grooves 7*a*, 7*b* are opened. Accordingly, each groove has a predetermined depth. Since the top surface TS of the side walls between the respective grooves is bonded to the cover plate 3 with the adhesive, each side wall is not broken at the time of grinding.

Figure 18A:
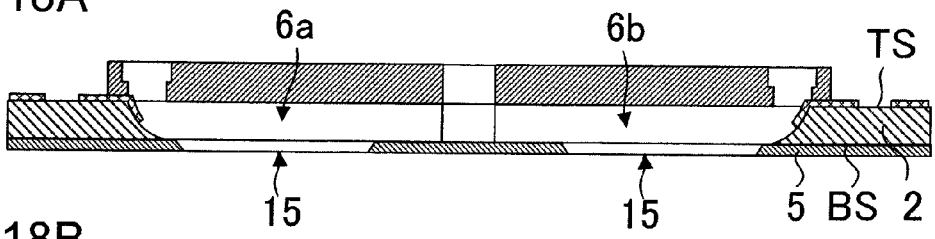
FIGS. 18A and 18B are diagrams for explaining the method of manufacturing a liquid jet head according to the seventh embodiment of the present invention.
Figure 18B:
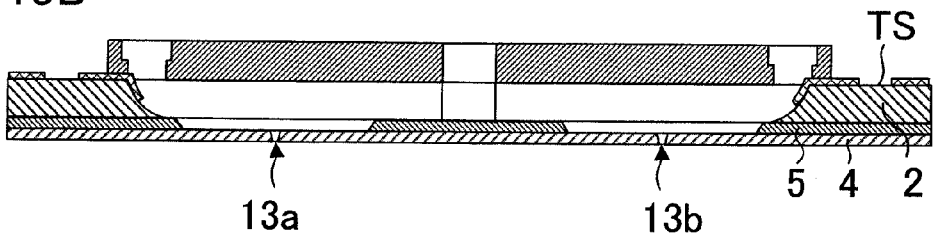

FIGS. 18A and 18B are schematic cross-sectional views for explaining a reinforcing plate adhesion step S42 and the second adhesion step S5. In the reinforcing plate adhesion step S42, a reinforcing plate 5 is adhered to the bottom surface BS of the actuator substrate 2 with an adhesive. The reinforcing plate 5 has through holes 15, which penetrate in the plate thickness direction at positions corresponding to the first and second ejection grooves 6*a*, 6*b*. Next, in the second adhesion step S5, a nozzle plate 4 having a first nozzle 13*a* and a second nozzle 13*b* is adhered to a bottom surface of the reinforcing plate 5 on the bottom surface BS side of the actuator substrate 2 while the first and second nozzles 13*a*, 13*b* are respectively communicated with the first and second ejection grooves 6*a*, 6*b*.

Figure 19:
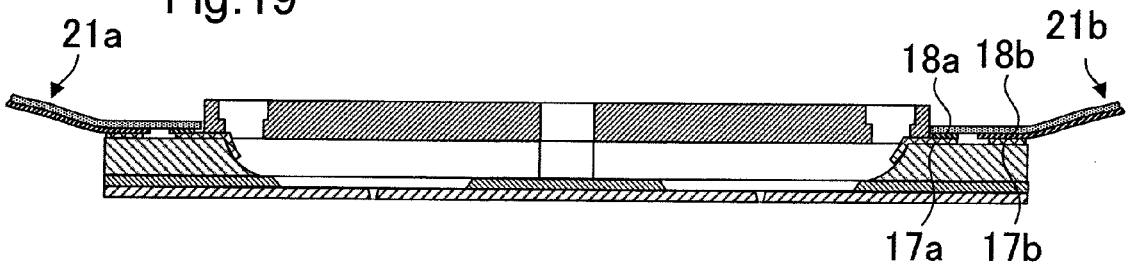
FIG. 19 is a diagram for explaining the method of manufacturing a liquid jet head according to the seventh embodiment of the present invention.
Figure 20:
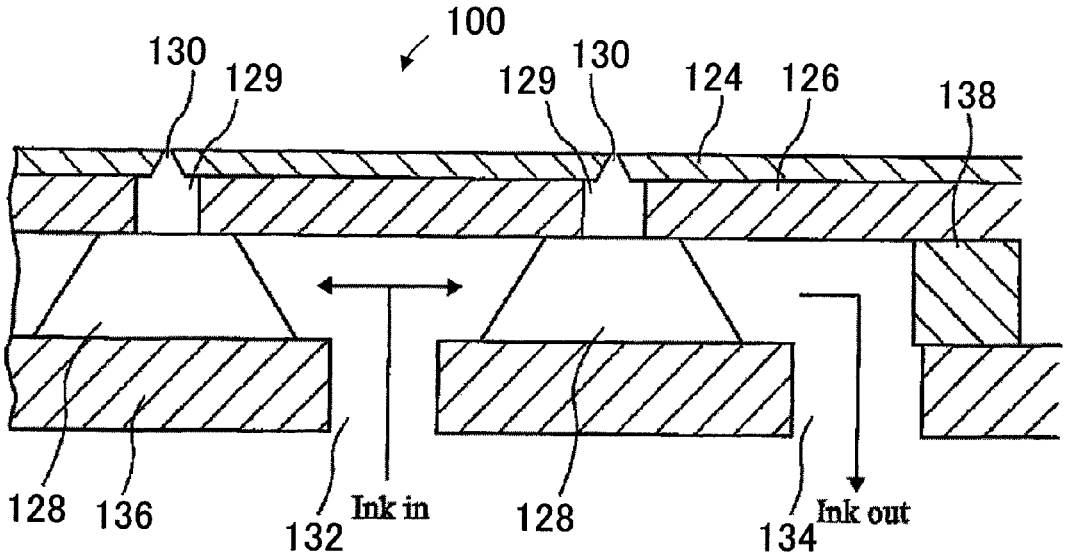
FIG. 20 is a schematic partial cross-sectional view of a conventionally known ink jet head.
Figure 21:
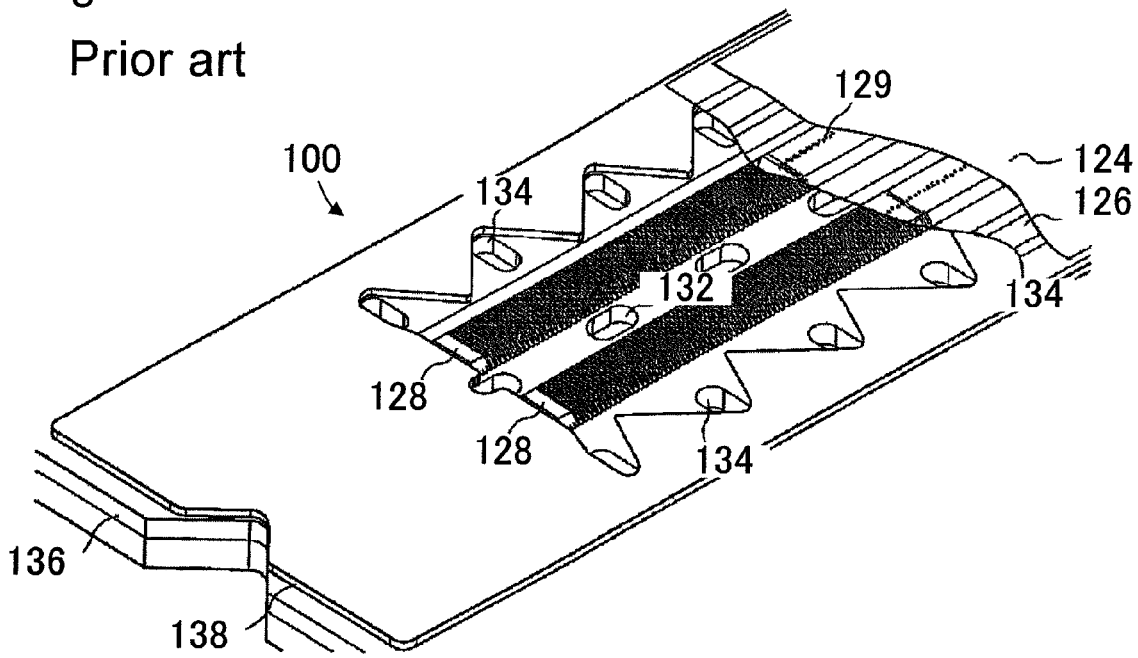
Fig.21 Prior art
FIG. 21 is a perspective view of the conventionally known ink jet head.
Figure 22:
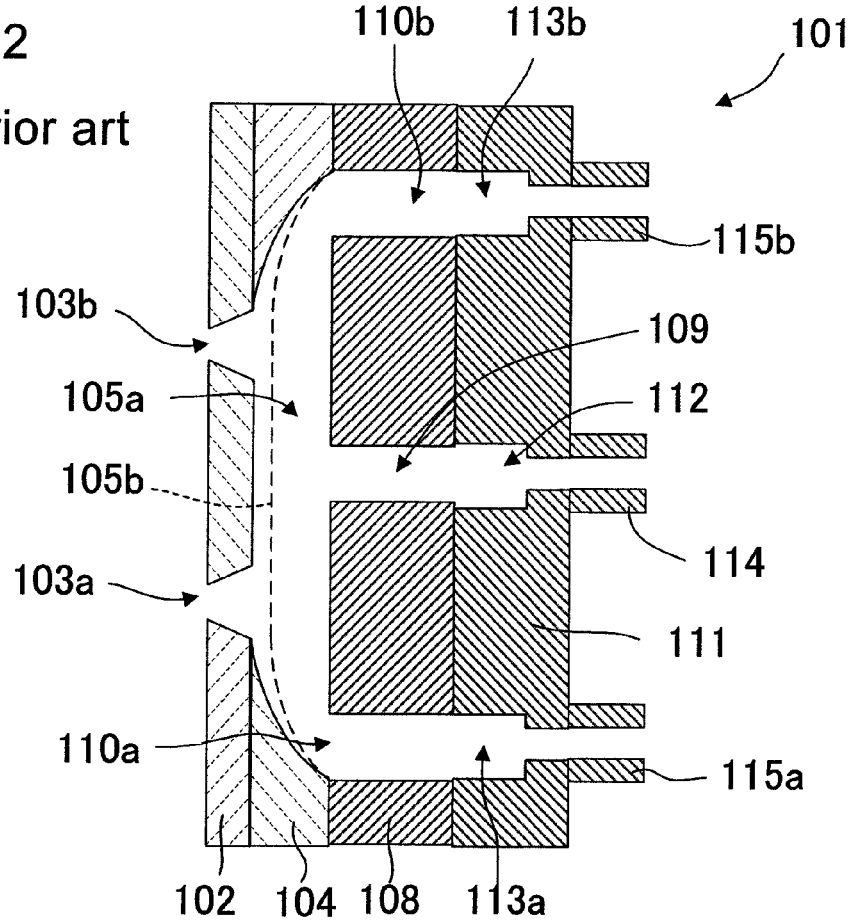
Fig.22 Prior art
FIG. 22 is a schematic cross-sectional view of a conventionally known liquid jet head.

FIG. 19 is a schematic cross-sectional view for explaining a flexible substrate adhesion step S51. Two flexible substrates 21*a*, 21*b* each having a common wiring 18*a* and an active wiring 18*b* are adhered to the top surface TS of the actuator substrate 2 such that the common wiring 18*a* and the active wiring 18*b* are electrically connected to the common terminal 17*a* and the active terminal 17*b*, respectively.

In this way, the common chamber 9 communicated with the respective first and second ejection grooves 6*a*, 6*b* can be easily formed in the actuator substrate 2 without requiring complicated steps. Further, by grinding each groove slightly deeper than the final depth thereof at the time of forming the groove, the width W of the cut-out inclined portion 27 of each groove can be made smaller. Accordingly, the number of actuator substrates 2 that can be taken from an actuator wafer can be increased and the cost of manufacturing the actuator substrate 2 can be remarkably reduced. Moreover, since the flexible substrates 21*a*, 21*b* are provided on the top surface TS of the actuator substrate 2, a thickness thereof is not limited.

What is claimed is:

1. A liquid jet head, comprising:

an actuator substrate including a groove array formed by alternately arraying an ejection groove and a dummy groove, and a common chamber communicating with one end of the ejection groove but not communicating with the dummy groove;

a cover plate including one chamber communicating with the common chamber and another chamber communicating with another end of the ejection groove, the cover plate being provided on a top surface of the actuator substrate so as to cover the groove array; and a nozzle plate including a nozzle communicating with the ejection groove, the nozzle plate being provided on a bottom surface of the actuator substrate so as to cover the groove array.

2. The liquid jet head according to claim 1, wherein:

the ejection groove includes a first ejection groove and a second ejection groove and the dummy groove includes a first dummy groove and a second dummy groove, the groove array includes a first groove array and a second groove array with the common chamber disposed therebetween, the first ejection groove and the first dummy groove being alternately arrayed in the first groove array, and the second ejection groove and the second dummy groove being alternately arrayed in the second groove array, the another chamber includes a first chamber and a second chamber with the one chamber disposed therebetween, the first chamber communicating with another end of the first ejection groove, and the second chamber communicating with another end of the second ejection groove, and the nozzle includes a first nozzle and a second nozzle, the first nozzle communicating with the first ejection groove, and the second nozzle communicating with the second ejection groove.

3. The liquid jet head according to claim 2, wherein the first ejection groove and the second ejection groove are formed straight in a groove direction.

4. The liquid jet head according to claim 2, wherein in an array direction of the first or second groove array, a plurality of the first ejection grooves and a plurality of the second ejection grooves have the same pitch, and the first ejection grooves are deviated from the second ejection grooves by a ½ pitch.

5. The liquid jet head according to claim 2, wherein in the array direction of the first or second groove array, the first nozzle forms a first nozzle array and the second nozzle forms a second nozzle array, a plurality of the first nozzles and a plurality of the second nozzles have the same pitch, and the first nozzles are deviated from the second nozzles by a ½ pitch.

6. The liquid jet head according to claim 2, wherein the groove direction of the first or second ejection groove is inclined relative to the array direction of the first or second groove array.

7. The liquid jet head according to claim 1, wherein the ejection groove is formed from the common chamber to the vicinity of an outer peripheral end of the actuator substrate in a direction intersecting an array direction of the groove array.

8. The liquid jet head according to claim 1, wherein the dummy groove is formed from the outer peripheral end of the actuator substrate to the vicinity of the common chamber.

9. The liquid jet head according to claim 1, wherein:

common electrodes electrically connected to each other are formed on both side surfaces of the ejection groove, active electrodes electrically separated from each other are formed on both side surfaces of the dummy groove, an active terminal is electrically connected to the two active electrodes formed on the side surfaces of the adjacent dummy grooves on adjacent sides, the active terminal being provided between the adjacent dummy grooves with the ejection groove disposed therebetween and on a top surface of the actuator substrate in the vicinity of the outer peripheral end thereof, and a common terminal is electrically connected to the common electrodes and is electrically separated from the active terminal, the common terminal being provided on the top surface of the actuator substrate in the vicinity of the other end of the ejection groove.

10. The liquid jet head according to claim 9, wherein the common electrodes are formed on substantially the upper half of the side surfaces of the ejection groove, and the active electrodes are formed on substantially the upper half of the side surfaces of the dummy groove.

11. The liquid jet head according to claim 9, wherein the cover plate covers the groove array, exposes the active terminal and the common terminal, and is adhered to the top surface of the actuator substrata.

12. The liquid jet head according to claim 9, further comprising:

a flexible substrate including a common wiring and a plurality of active wirings and bonded to the top surface of the actuator substrate, wherein the common wiring is electrically connected to a plurality of the common terminals, and the plurality of active wirings are electrically connected to the respective plurality of active terminals.

13. The liquid jet head according to claim 1, further comprising a reinforcing plate provided between the bottom surface of the actuator substrate and the nozzle plate and provided with through holes penetrating at positions corresponding to the nozzles in a plate thickness direction.

14. The liquid jet head according to claim 1, wherein the liquid jet head is configured so that liquid is supplied from outside of the liquid jet head to the common chamber and is discharged from the another chamber to the outside.

15. The Liquid jet head according to claim 1, wherein a reinforcing bridge is provided at the another chamber.

16. A liquid jet apparatus, comprising:

the liquid jet head according to claim 1;

a moving mechanism configured to relatively move the liquid jet head and a recording medium;

a liquid supply tube configured to supply liquid to the liquid jet head; and a liquid tank configured to supply the liquid to the liquid supply tube.

17. A method of manufacturing a liquid jet head, comprising:

a groove formation step of forming a first groove array in which first ejection grooves are alternately arrayed with first dummy grooves, and forming a second groove array in which second ejection grooves are alternately arrayed with second dummy grooves, the first and second groove arrays being formed in parallel on an actuator substrate including a piezoelectric material;

a common chamber formation step of forming, on the actuator substrate between the first groove array and the second groove array, a common chamber communicating with each one end of the first and second ejection grooves but not communicating with the first and second dummy grooves;

a cover plate formation step of forming, on a cover plate, one chamber, and forming a first chamber and a second chamber with the one chamber disposed therebetween;

a first adhesion step of adhering the cover prate to a top surface of the actuator subs rate by communicating the one chamber with the common chamber, by communicating the first chamber with another end of the first ejection groove, and by communicating the second chamber with another end of the second ejection groove; and a second adhesion step of adhering a nozzle plate including a first nozzle and a second nozzle to a bottom surface of the actuator substrate by communicating the first nozzle with the first ejection groove and by communicating the second nozzle with the second ejection groove.

18. The method of manufacturing a liquid jet head according to claim 17, wherein the groove formation step is a step of forming the groove at a depth which does not reach the bottom surface of the actuator substrate opposite to the top surface thereof, the method further comprising a grinding step of grinding the bottom surface of the actuator substrate after the first adhesion step so as to cause the first and second ejection grooves and the common chamber to penetrate the actuator substrate.

19. The method of manufacturing a liquid jet head according to claim 17, wherein the second adhesion step includes a step of adhering a reinforcing plate to the bottom surface of the actuator substrata and then adhering the nozzle plate to the reinforcing plate, time reinforcing plate having through holes penetrating at positions corresponding to the first and second nozzles in a plate thickness direction.

20. The method of manufacturing a liquid jet head according to claim 17, further comprising, after the groove formation step, a conductive film formation step of forming a conductive film on the top surface of the actuator substrate by oblique deposition.

21. The method of manufacturing a liquid jet head according to claim 20, wherein in the conductive film formation step, a mask is provided on the top surface of the actuator substrate so as to cover an area where the common chamber is formed, end portions of the first and second dummy grooves on the common chamber side, and end portions of the first and second ejection grooves on the common chamber side, and thereafter, the conductive film is formed.

* * * * *